US011834244B2

(12) United States Patent
Shiba et al.

(10) Patent No.: US 11,834,244 B2
(45) Date of Patent: Dec. 5, 2023

(54) SHEET MEMBER CONTAINER

(71) Applicant: Kao Corporation, Tokyo (JP)

(72) Inventors: Kenichi Shiba, Sumida-ku (JP); Akira Kuragano, Sumida-ku (JP); Takahiro Otsuka, Sumida-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 17/906,130

(22) PCT Filed: Mar. 13, 2020

(86) PCT No.: PCT/JP2020/011227
§ 371 (c)(1),
(2) Date: Sep. 12, 2022

(87) PCT Pub. No.: WO2021/181689
PCT Pub. Date: Sep. 16, 2021

(65) Prior Publication Data
US 2023/0108758 A1 Apr. 6, 2023

(51) Int. Cl.
*B65D 75/00* (2006.01)
*B65D 75/32* (2006.01)
(Continued)

(52) U.S. Cl.
CPC ..... *B65D 75/322* (2013.01); *B65D 75/008* (2013.01); *B65D 75/5883* (2013.01); *B65D 77/04* (2013.01)

(58) Field of Classification Search
CPC .. B65D 75/38; B65D 75/008; B65D 75/5872; B65D 75/52; B65D 77/04; B65D 33/02
(Continued)

(56) References Cited

U.S. PATENT DOCUMENTS 5,174,458 A * 12/1992 Segati ..... B65D 1/0292 220/666
5,261,881 A * 11/1993 Riner ..... A61M 5/282 604/110
(Continued)

FOREIGN PATENT DOCUMENTS

CN 108025836 A 5/2018
CN 109641681 A 4/2019
(Continued)

OTHER PUBLICATIONS

International Search Report and partial English translation dated Apr. 14, 2020 in PCT/JP2020/011227 filed on Mar. 13, 2020 (citing references 3, 15 & 18-20 therein, 5 pages).

*Primary Examiner* — Peter N Helvey
(74) *Attorney, Agent, or Firm* — Oblon, McClelland, Maier & Neustadt, L.L.P.

(57) ABSTRACT

A sheet member container having one or more sheet members including a main-body forming sheet member in which a plurality of film layers including an inner film layer and an outer film layer are stacked; a containing portion that accommodates contents; a container main body including the main-body forming sheet member, and surrounding the containing portion; and a peripheral edge sealing portion in which the one or more sheet members are folded along a folding line, and peripheral edge portions of the one or more sheet members are attached to each other.

20 Claims, 11 Drawing Sheets

(51) Int. Cl.
*B65D 75/58* (2006.01)
*B65D 77/04* (2006.01)

(58) Field of Classification Search
USPC ..... 383/109
See application file for complete search history.

(56) References Cited

U.S. PATENT DOCUMENTS 6,176,613 B1 * 1/2001 Chen ..... B65D 33/00 383/18
6,607,097 B2 * 8/2003 Savage ..... B65D 75/5877 220/62.12
6,673,301 B2 * 1/2004 Cargile ..... B65D 35/08 222/206
8,206,033 B2 * 6/2012 Sato ..... B29C 66/133 383/906
8,960,183 B2 * 2/2015 Husson, Jr. ..... C02F 1/001 220/592.01
D753,995 S * 4/2016 Sanfilippo ..... D9/433
9,327,867 B2 * 5/2016 Stanley ..... B65D 75/008
10,457,457 B2 * 10/2019 Arent ..... B65D 85/70
2008/0149666 A1 * 6/2008 LaFlamme ..... B65D 75/5872 222/105
2013/0248540 A1 * 9/2013 Darby ..... B65D 75/5877 229/5.5
2014/0033655 A1 * 2/2014 Stanley ..... B65B 3/04 53/456
2015/0034670 A1 * 2/2015 Stanley ..... B65D 77/28 222/105
2015/0121810 A1 * 5/2015 Bourgeois ..... B65B 9/2049 53/434
2015/0122373 A1 * 5/2015 Bourgeois ..... B65D 33/02 141/12
2015/0122840 A1 * 5/2015 Cox ..... B65D 75/20 222/213
2015/0122841 A1 * 5/2015 McGuire ..... B65D 81/03 222/206
2015/0122846 A1 * 5/2015 Stanley ..... B65D 75/5877 222/206
2016/0176578 A1 * 6/2016 Stanley ..... B65D 35/02 206/459.5
2016/0176582 A1 * 6/2016 McGuire ..... B65D 35/24 206/277
2016/0176583 A1 * 6/2016 Ishihara ..... B65D 75/008 53/452
2016/0176584 A1 * 6/2016 Ishihara ..... B65D 35/02 493/243
2016/0176597 A1 * 6/2016 Ishihara ..... B31B 70/00 493/243
2016/0221727 A1 * 8/2016 Stanley ..... B65D 75/525
2016/0297569 A1 * 10/2016 Berg, Jr. ..... B65D 75/5811
2016/0297589 A1 10/2016 You et al.
2016/0297590 A1 * 10/2016 You ..... B05B 11/026
2016/0297591 A1 * 10/2016 You ..... B05B 11/026
2016/0325518 A1 * 11/2016 Ishihara ..... B31B 50/00
2016/0362228 A1 * 12/2016 McGuire ..... B05B 11/026
2017/0001782 A1 * 1/2017 Arent ..... B65D 75/008
2019/0168941 A1 6/2019 Otsuka et al.
2021/0163181 A1 * 6/2021 Kodama ..... B65D 75/008
2021/0339929 A1 * 11/2021 Otsuka ..... B32B 7/06
2022/0033161 A1 * 2/2022 Shibutani ..... B32B 7/12
2022/0281668 A1 * 9/2022 Bloedt ..... B67D 3/0061
2022/0324624 A1 * 10/2022 Kodama ..... B65D 75/5866
2023/0072263 A1 * 3/2023 Takano ..... B65D 75/5877
2023/0108758 A1 * 4/2023 Shiba ..... B05B 11/026 383/109
2023/0174282 A1 * 6/2023 Takano ..... B31B 70/81 383/3
2023/0211576 A1 * 7/2023 Ferracane ..... B65D 21/08 428/35.7

FOREIGN PATENT DOCUMENTS

JP 2018-108842 A 7/2018
JP 2018-144860 A 9/2018
JP 2018-144886 A 9/2018
JP 2018-144888 A 9/2018
JP 6506414 B2 4/2019
JP 2019-214398 A 12/2019

* cited by examiner

SHEET MEMBER CONTAINER

CROSS-REFERENCE TO RELATED APPLICATIONS

The present application is a 35 U.S.C. § 371 national stage application of International patent application PCT/JP2020/011227, filed Mar. 13, 2020. The entire content of this application is incorporated herein by reference.

TECHNICAL FIELD

The present invention relates to a sheet member container.

BACKGROUND ART

A sheet member container that is a structure in which a plurality of films are laminated and a filler such as air is contained between layers of the films is described, for example, in Patent Document 1. The sheet member container includes a containing portion that accommodates contents, a container forming sheet member (described as an inner container forming sheet member in the document) that forms a container main body surrounding the containing portion, and a main-body forming sheet member (described as a container main-body forming sheet member in the document) in which a plurality of film layers are stacked, and the main-body forming sheet member includes a main-body sealing portion (described as an inner container sealing portion in the document) in which a plurality of film layers are attached to each other, and a non-attached region in which a plurality of film layers are partially not attached to each other. In the container, a filling portion is formed in which a filler is contained between layers of the plurality of film layers of the non-attached region.

CITATION LIST

PATENT DOCUMENT 1: Japanese Patent Laid-Open No. 2018-144860

SUMMARY OF THE INVENTION

The present invention relates to a sheet member container including one or a plurality of sheet members including a main-body forming sheet member in which a plurality of film layers including an inner film layer and an outer film layer are stacked, the sheet member container includes a containing portion that accommodates contents, and a container main body including the main-body forming sheet member, and surrounding the containing portion, wherein the main-body forming sheet member includes a main-body sealing portion that is an attached region of the inner film layer and the outer film layer, and a non-attached region in which the inner film layer and the outer film layer are partially not attached, and includes a filling portion in which a filler is contained between layers of the inner film layer and the outer film layer in the non-attached region, the sheet member container includes a peripheral edge sealing portion in which the one or plurality of sheet members are folded along a folding line, and peripheral edge portions of the one or plurality of sheet members are attached to each other, wherein the container main body is formed into a shape including a body portion, the peripheral edge sealing portion includes a side edge sealing portion extending along each of a pair of side edges of the body portion, and in a region of at least part of the side edge sealing portion in an extending direction, a second non-attached region in which film layers forming the sheet member container are not attached to each other is disposed between the side edge sealing portion and the main-body sealing portion.

BRIEF DESCRIPTION OF THE DRAWINGS

FIG. 4B is a partially enlarged view of FIG. 4A.

FIG. 10A and FIG. 10B are views illustrating a sheet member container according to Modification 2 of the first exemplary embodiment, in which FIG. 10A is a back view, and FIG. 10B is a plane view illustrating a container forming sheet member.

FIG. 11A and FIG. 11B are flat cross-sectional views illustrating a state where a filler is contained in a sheet member container according to a second exemplary embodiment, in which FIG. 11B is a partially enlarged view of FIG. 11A.

DESCRIPTION OF EMBODIMENTS

Figure 1:
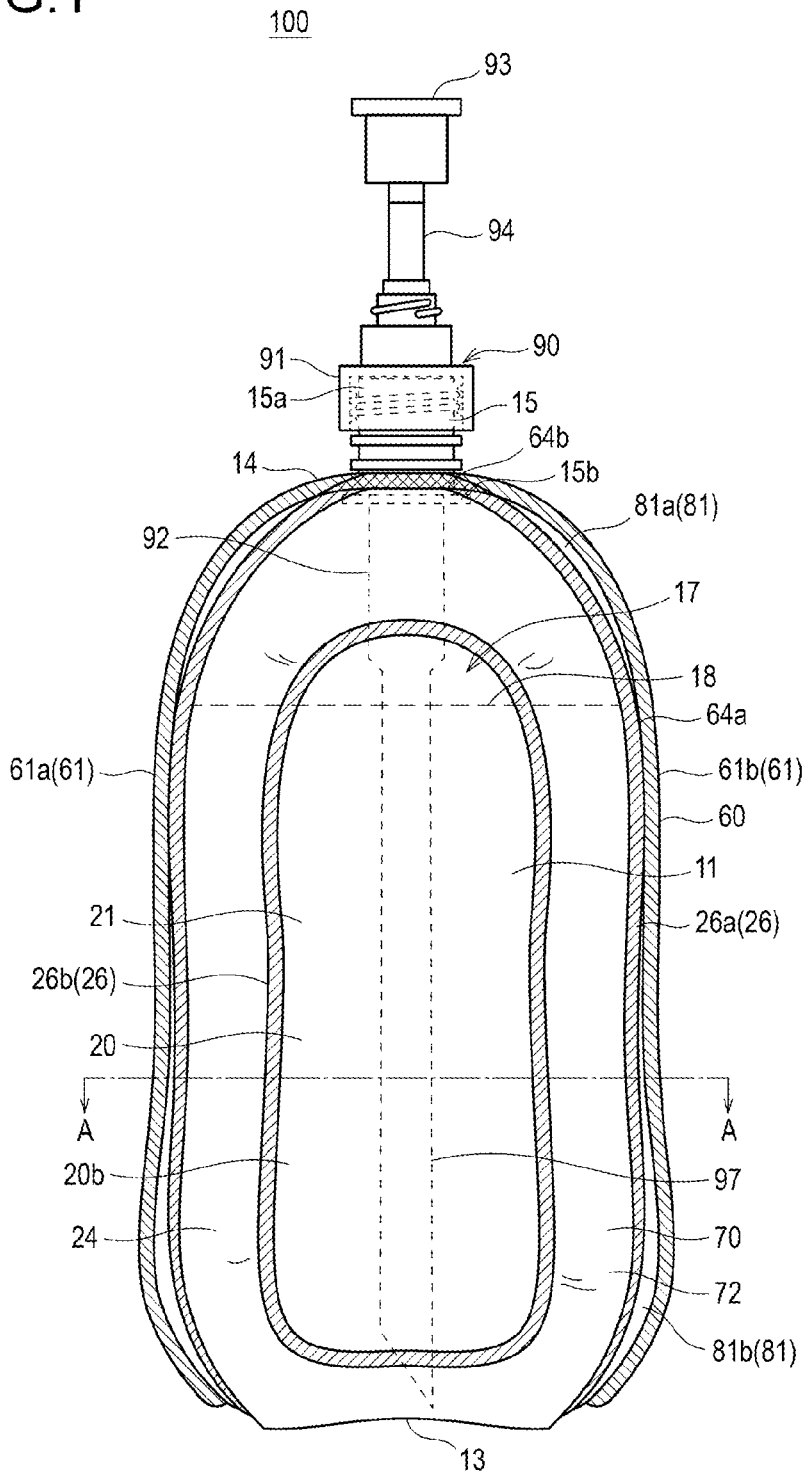
FIG. 1 is a back view illustrating a state where a filler is contained in a sheet member container according to a first exemplary embodiment.

According to investigation by the present inventors, there is still room for improvement in terms of texture at the time of gripping a sheet member container of Patent Document 1.

The present invention relates to a sheet member container with softer texture.

Below, examples of exemplary embodiments according to the present invention will be described with reference to the drawings.

Note that, in all the drawings, the same reference characters are attached to similar constituent components, and detailed explanation thereof will not be repeated.

First Exemplary Embodiment

Figure 2:
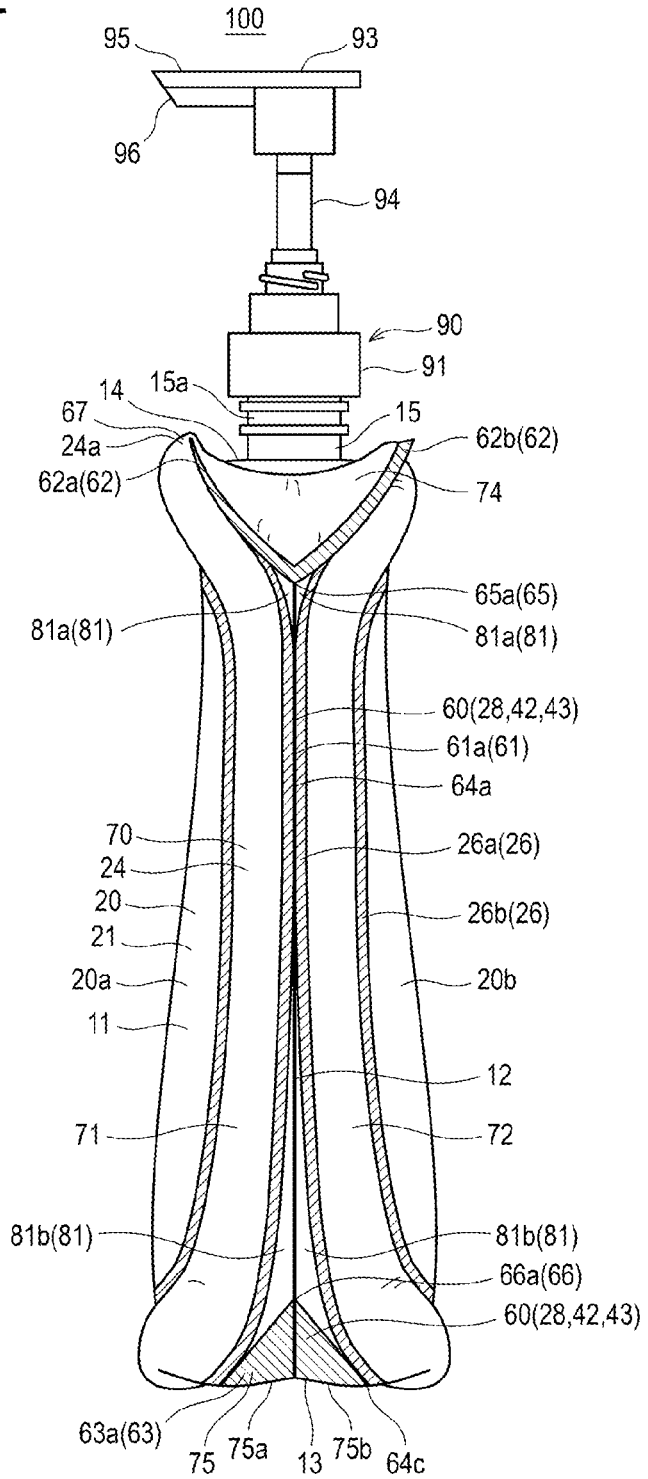
FIG. 2 is a side view illustrating a state where the filler is contained in the sheet member container according to the first exemplary embodiment.
Figure 3:
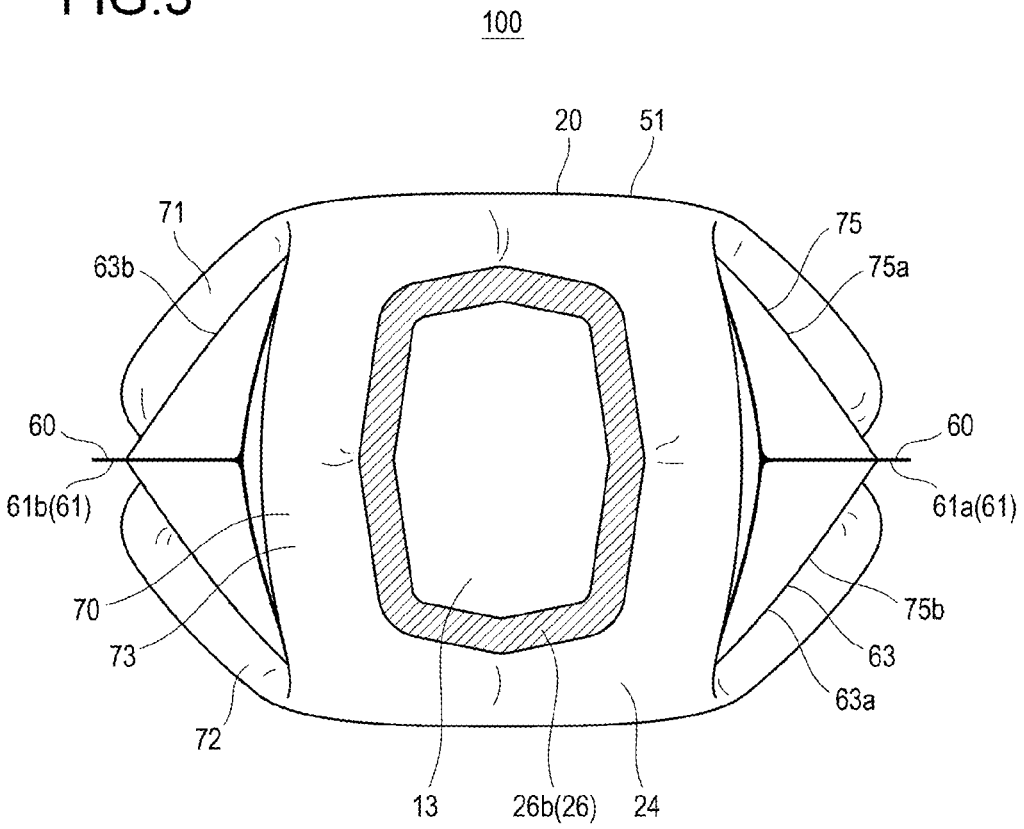
FIG. 3 is a bottom view illustrating a state where the filler is contained in the sheet member container according to the first exemplary embodiment.

First, a first exemplary embodiment will be described with reference to FIG. 1 to FIG. 8. In addition, FIG. 1, FIG. 2 and FIG. 3 illustrate a sheet member container 100 in a state where a filler is contained in a filling portion.

The sheet member container 100 according to this exemplary embodiment includes one or a plurality of sheet members including a main-body forming sheet member 21 in which a plurality of film layers including an inner film layer 23 and an outer film layer 22 are stacked.

The sheet member container 100 includes a containing portion 17 that accommodates contents 18, and a container main body 20 that surrounds the containing portion 17. The container main body 20 includes the main-body forming sheet member 21.

The main-body forming sheet member 21 includes a main-body sealing portion 26 that is an attached region of the inner film layer 23 and the outer film layer 22, and a non-attached region 24 in which the inner film layer 23 and the outer film layer 22 are partially not attached, and includes a filling portion 70 in which a filler is contained between layers of the inner film layer 23 and the outer film layer 22 in the non-attached region 24. The sheet member container 100 includes a peripheral edge sealing portion 60 in which one or a plurality of sheet members are folded along folding lines 101, 102, 103, 104, and 105 (see FIG. 7 and FIG. 8), and in which peripheral edge portions of one or a plurality of sheet members are attached to each other.

The container main body 20 is formed into a shape including a body portion 11. The peripheral edge sealing portion 60 includes a side edge sealing portion 61 extending along each of a pair of side edges of the body portion, and in a region of at least part of the side edge sealing portion 61 in its extending direction, a second non-attached region 81 in which film layers that form the sheet member container 100 are not attached to each other is disposed between the side edge sealing portion 61 and the main-body sealing portion 26.

In a case of this exemplary embodiment, in the second non-attached region 81, all the film layers that form the sheet member container 100 are not attached. Therefore, in the second non-attached region 81, at least the outer film layer 22 and inner film layer 23 are not attached to each other.

According to this exemplary embodiment, since all the film layers that form the sheet member container 100 are not attached to each other in the second non-attached region 81, the second non-attached region 81 is softer than the side edge sealing portion 61 and the main-body sealing portion 26. That is, the sheet member container 100 includes a portion relatively softer than the side edge sealing portion 61 and the main-body sealing portion 26, between the side edge sealing portion 61 and the main-body sealing portion 26. Consequently, when a user grips the body portion 11, a side edge portion 12 of the body portion 11 is easily bent along user's fingers and palm, and texture at the time of gripping the sheet member container 100 can be softened.

Additionally, in a case where strong impact is on the sheet member container 100 (due to falling or the like), when the side edge portion 12 has a favorable flexibility, it can be expected that the impact on the side edge sealing portion 61 is reduced. Consequently, it is possible to favorably maintain a state where peripheral edge portions of one or a plurality of sheet members are attached to each other in the side edge sealing portion 61, and hence structural strength of the sheet member container 100 can be sufficiently acquired.

In the present invention, the mode of the sheet member container 100 is not specifically limited, and it may be possible to employ a mode in which the container can stand independently, or a mode in which the container does not stand independently and is expected to be mounted in a lying position. In the case of this exemplary embodiment, the sheet member container 100 includes a bottom portion 13 as a bottom portion, and is a freestanding container that can stand independently in a state where the bottom portion 13 is mounted on a horizontal mounting surface.

In this exemplary embodiment, the positional relationship (up-down relationship or the like) of each constituent component of the sheet member container 100 is described in terms of a positional relationship in a state where the sheet member container 100 is caused to stand independently as illustrated in FIG. 1 and FIG. 2, unless otherwise specified. However, the positional relationship in this description does not necessarily match the positional relationship at the time of using or manufacturing the sheet member container 100.

Furthermore, in connection with the positional relationship of each constituent component of the sheet member container 100, the positional relationship illustrated in each of the drawings may be described.

A front surface side (side away from the viewer of a paper surface in FIG. 1) of the sheet member container 100 is referred to as a forward direction; a back surface side (side of the viewer of FIG. 1) of the sheet member container 100 is referred to as a rearward direction; the left side (right side in FIG. 1) as viewed from the front surface of the sheet member container 100 is referred to as a leftward direction; and the right side (left side in FIG. 1) as viewed from the front surface of the sheet member container 100 is referred to as a rightward direction. Furthermore, the left-right direction of the sheet member container 100 may be referred to as a widthwise direction.

In the present invention, types of contents 18 are not specifically limited. The contents 18 include, for example, shampoo, conditioner, body soap, detergent, bleach, softener, beverage, and food, and include engine oil, chemical agent, and the like.

In addition, the contents 18 may be a liquid (including a form of paste), or may be a solid (for example, in a form of particle (including a form of grain) or in a form of powder).

In the case of this exemplary embodiment, the contents 18 are, for example, a liquid.

In a case where the contents 18 are a liquid, a viscosity of the contents 18 at, for example, 30° C. preferably falls in a range of equal to or more than 1 mPa·s and equal to or less than 120000 mPa·s (measured by a B-type viscometer; for example, measured using viscometer TV-10 or viscometer TVB-10 made by Toki Sangyo Co., LTD. or the like), and more preferably falls in a range of equal to or more than 1 mPa·s and equal to or less than 60000 mPa·s.

The filler contained in the filling portion 70 includes a fluid (gas or liquid), a solid (for example, a powder-granular material, resin pellets, or the like), or a semi-solid (for example, blowing agent or the like), and is preferably a gas such as air.

In the case of this exemplary embodiment, the container main body 20 is formed into a bag shape including the body portion 11 described above, a top portion 14 located on an upper side of the body portion 11, and the bottom portion 13 located on a lower side of the body portion 11. However, the present invention is not limited to this example, and the container main body 20 does not have to include the top portion 14, or does not have to include the bottom portion 13.

Also, the upper edge of the body portion 11 is formed into an arc shape projecting upward.

The container main body 20 surrounds the containing portion 17 (surrounds an inner bag 40 described later in the case of this exemplary embodiment). The container main body 20 forms a shell of the sheet member container 100. Below, the body portion 11, the top portion 14 and the bottom portion 13 of the container main body 20 may be referred to as the body portion 11, the top portion 14 and the bottom portion 13 of the sheet member container 100.

The sheet member container 100 further includes a cylindrical mouth neck portion protruding upward from the top portion 14. The mouth neck portion may include an outlet cylinder portion 15*a* of a spout member 15 described later.

As illustrated in FIG. 1 and FIG. 2, the body portion 11 includes a first surface portion 20*a* (front side panel) and a second surface portion 20*b* (rear side panel), which are opposed to each other with the containing portion 17 being disposed therebetween. The first surface portion 20*a* is located on the front surface side, and the second surface portion 20*b* is located on the back surface side.

The planar shape of the top portion 14 is not specifically limited, but in the case of this exemplary embodiment, the top portion 14 is formed into a shape having a front-back width reduced as being from a central portion toward the left in the widthwise direction, and reduced as being from the central portion toward the right in the widthwise direction. The top portion 14 is formed into, for example, a horizontal tonsil shape.

The container main body 20 is formed by folding the main-body forming sheet member 21 (see FIG. 5 and FIG. 7) and attaching peripheral edge portions of the main-body forming sheet member 21 to each other (attaching the portions to each other via an inner-bag forming sheet member 41 in the case of this exemplary embodiment).

In the case of this exemplary embodiment, the sheet member container 100 further includes, for example, the inner bag 40 disposed inside of the container main body 20.

Figure 6:
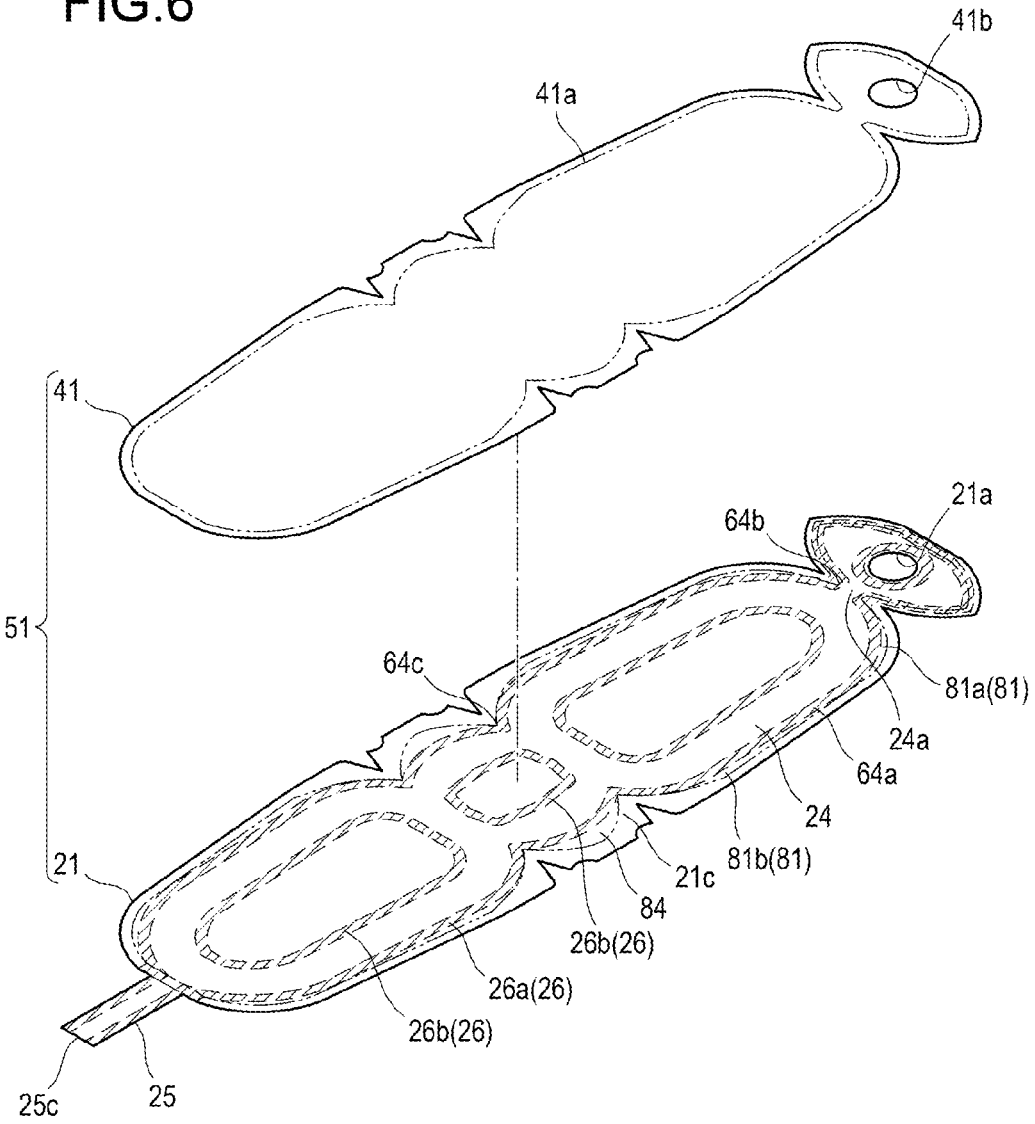
FIG. 6 is an exploded perspective view illustrating an inner-bag forming sheet member and the main-body forming sheet member.
Figure 7:
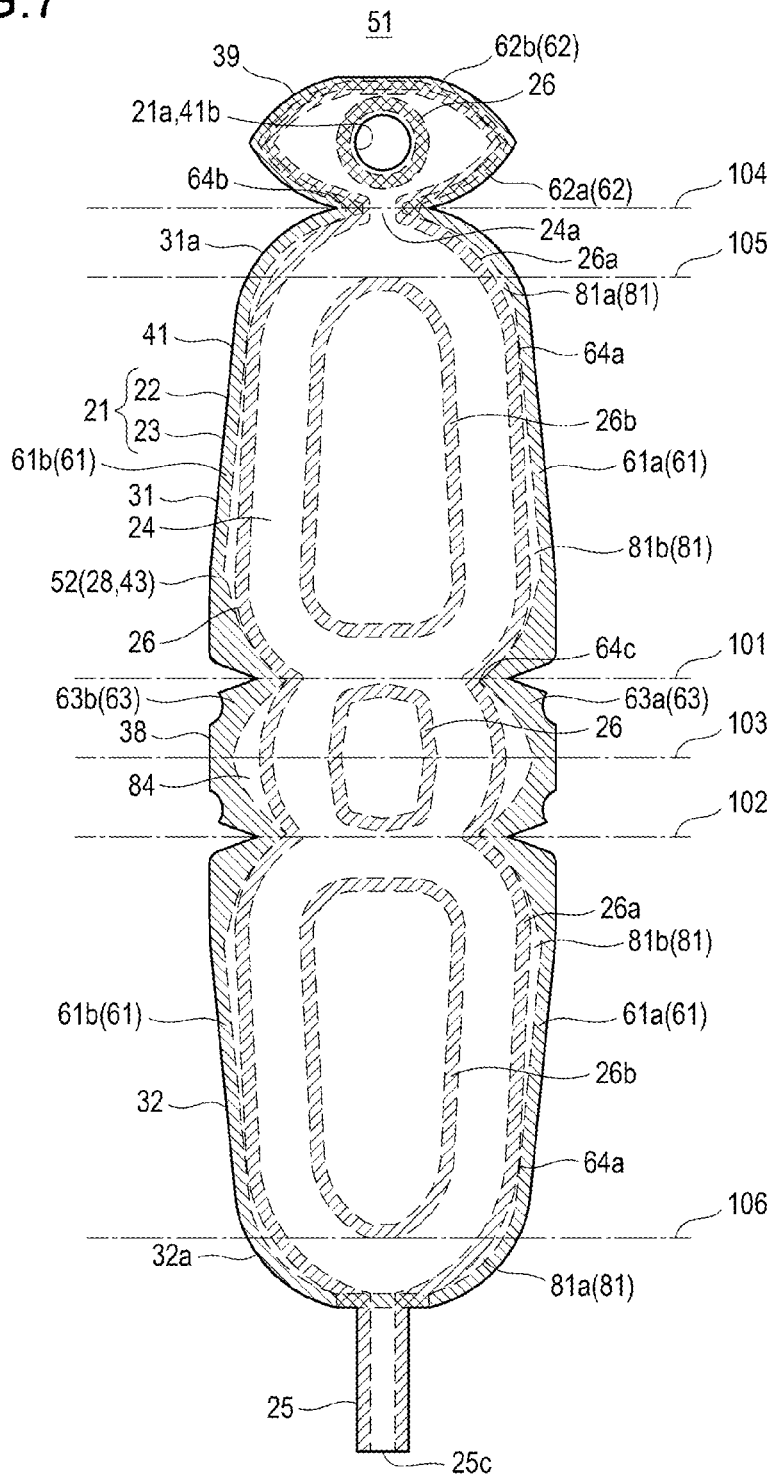
FIG. 7 is a plane view illustrating a container forming sheet member including the inner-bag forming sheet member and the main-body forming sheet member that are stacked on each other.

The inner bag 40 is formed by attaching portions of a peripheral edge portion of the inner-bag forming sheet member 41 (see FIG. 6) to each other (see FIG. 7). That is, the inner-bag forming sheet member 41 is folded and the peripheral edge portions of the inner-bag forming sheet member 41 are attached to each other, to form the inner bag 40 having a bag shape. The inner bag 40 is covered with the container main body 20. The inner bag 40 includes the containing portion 17 in the inner bag 40.

However, in the present invention, in a case where an inner container defining the containing portion 17 is disposed inside of the container main body 20, the inner container is not limited to the inner bag 40 including a sheet member, and may be formed, for example, through blow molding.

A shape of the inner bag 40 is not specifically limited. However, in the case of this exemplary embodiment, the inner bag 40 is formed into a shape similar to that of the container main body 20.

The inner bag 40 includes a first main surface portion 40*a* located on the front surface side and a second main surface portion 40*b* located on the back surface side, with the containing portion 17 being disposed therebetween.

The sheet member container 100 includes, for example, the spout member 15 disposed to penetrate through the top portion 14, and a cap portion 90 mounted (for example, detachably mounted) to the spout member 15.

More specifically, for example, as illustrated in FIG. 1, the spout member 15 includes the cylindrical outlet cylinder portion 15*a* through which the contents 18 are caused to pass, and a plate shape portion 15*b* having a plate shape and disposed at one end (lower end) of the outlet cylinder portion 15*a* in an axial direction to be perpendicular to this axial direction, the portions being provided in an integral manner. The outlet cylinder portion 15*a* has an outer peripheral surface in which a thread is formed, and the outlet cylinder portion 15*a* has an external screw shape. The plate shape portion 15*b* is disposed, for example, on an inner surface or an external surface of a portion disposed along the top portion 14 in the inner-bag forming sheet member 41.

The cap portion 90 includes an attachment portion 91 that is a cylindrical portion with the external screw shape removably screwed to the outlet cylinder portion 15*a*, a pump portion 92 fixed to the attachment portion 91, a dip tube 97 extending downward from the pump portion 92, and a head portion 93 held by the pump portion 92 to be raised and lowered to the pump portion 92.

The head portion 93 includes, for example, a support cylinder portion 94 protruding upward from the pump portion 92, and a nozzle portion 95 protruding horizontally from an upper end portion of the head portion 93, and a discharge port 96 through which the contents 18 are discharged is formed at a tip end of the nozzle portion 95.

When the head portion 93 is pushed into the pump portion 92 (pushed downward), the pump portion 92 operates to discharge the contents 18 through the discharge port 96.

Figure 5:
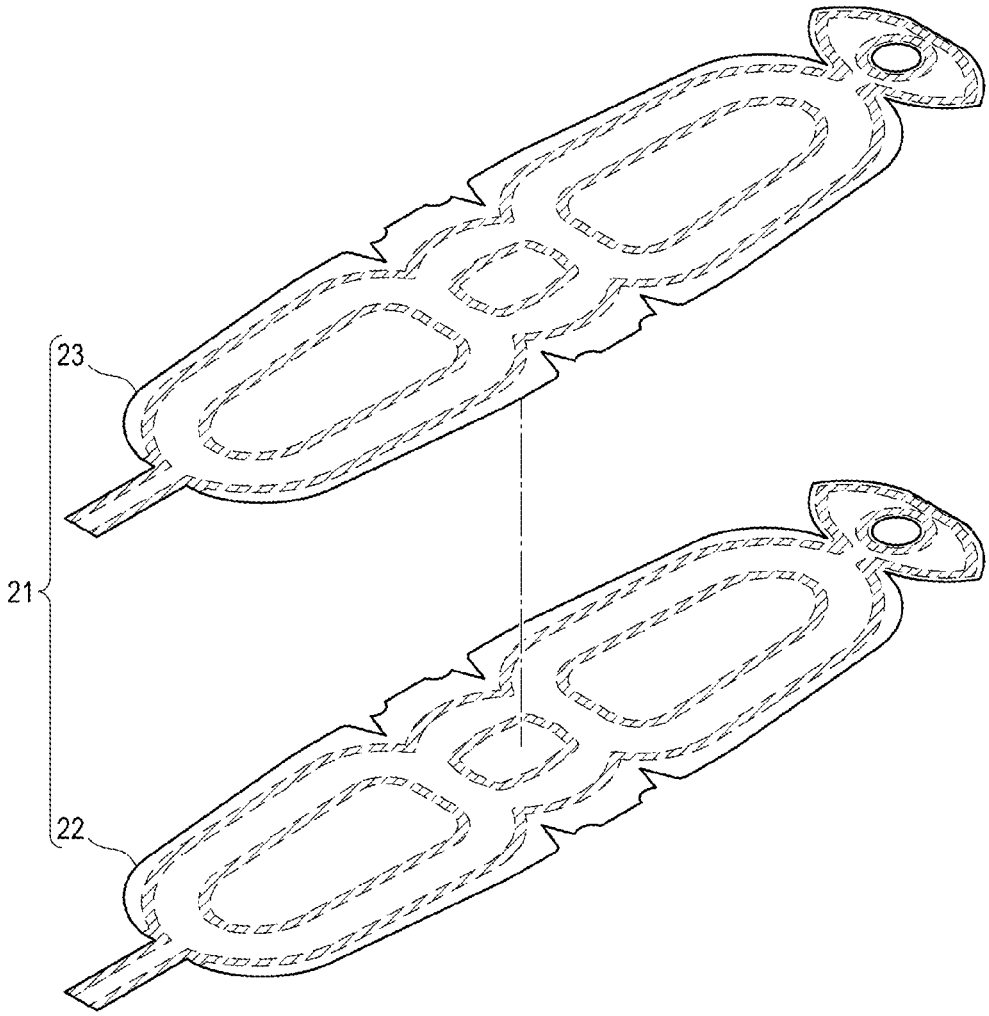
FIG. 5 is an exploded perspective view illustrating an inner film layer and an outer film layer of a main-body forming sheet member.

As illustrated in FIG. 5 and FIG. 7, the main-body forming sheet member 21 is formed by stacking and attaching, to each other, the outer film layer 22 that forms the external surface side of the container main body 20 and the inner film layer 23 that constitutes the inner surface side of the container main body 20. That is, as one example, in the case of this exemplary embodiment, the main-body forming sheet member 21 includes two film layers including the outer film layer 22 and the inner film layer 23. However, the present invention is not limited to this example. The main-body forming sheet member 21 may include a film layer other than the outer film layer 22 and the inner film layer 23.

In the case of this exemplary embodiment, the outer film layer 22 and the inner film layer 23 are formed into the same shape as each other. However, the present invention is not limited to this example. The outer film layer 22 and the inner film layer 23 may have shapes different from each other. In a case where the shapes are different, it is preferable that the shape of the outer film layer 22 is larger than that of the inner film layer 23.

In the outer film layer 22 and the inner film layer 23, insert holes are formed into which the outlet cylinder portion 15*a* of the spout member 15 is inserted.

As described above, in the main-body forming sheet member 21, the non-attached region 24 in which the outer film layer 22 and the inner film layer 23 are partially not attached to each other is formed.

FIG. 5 illustrates a region in which the outer film layer 22 and the inner film layer 23 are attached to each other to form the main-body sealing portion 26, with hatching rising to the right for convenience.

FIG. 1, FIG. 2, FIG. 3, FIG. 6, FIG. 7 and FIG. 8 illustrate a region in which the outer film layer 22 and the inner film layer 23 are attached to each other to define the non-attached region 24, that is, a region in which the main-body sealing portion 26 is formed, with hatching rising to the right for convenience.

Further, FIG. 6 illustrates, with an alternate long and two short dashes line, a seal boundary line 21*c* that is a boundary line between the seal region of the peripheral edge portion of the main-body forming sheet member 21 and another region. In the case of this exemplary embodiment, the outer film layer 22 and the inner film layer 23 are attached to each other and the inner film layer 23 and the inner-bag forming sheet member 41 are attached to each other, in a region outside of the seal boundary line 21*c* of the main-body forming sheet member 21 when a bag is formed.

As for a method of attaching the outer film layer 22 and the inner film layer 23 together, heat sealing, ultrasonic sealing, attaching with adhesive or the like may be used as an example.

For example, a non-attaching treatment is partially applied to a surface of one or both of the outer film layer 22 and the inner film layer 23, this surface facing a surface of the other one. The non-attaching treatment can be easily performed by applying a non-attaching agent (so-called adhesion inhibiting agent) to bring an adhesion inhibiting state. For the adhesion inhibiting agent, any agent can be used, provided that it can inhibit the outer film layer 22 and the inner film layer 23 from being attached together. For the adhesion inhibiting agent, it is possible to preferably use, for example, printing ink, medium ink, ink dedicated to adhesion inhibition, or the like for use in offset printing, flexography, and letterpress printing (relief printing). In addition, it is also possible to preferably use thermosetting ink or UV curable ink. The range in which the non-attaching treatment is applied is to be the non-attached region 24.

In the non-attached region 24 and the second non-attached region 81, a filler is put into the non-attached region 24 to form the filling portion 70 in which the filler is contained.

In the present invention, a non-attached region other than the non-attached region 24 and the second non-attached region 81 may exist, and in the other non-attached region, the filler may not be contained, or the filler may be contained at a pressure lower than that of the non-attached region 24.

In the case of this exemplary embodiment, as illustrated in FIG. 1 to FIG. 3, the filling portion 70 includes, for example, a first body-portion filling portion 71 formed into a circular shape along a peripheral edge portion of the first surface portion 20*a*, a second body-portion filling portion 72 formed into a circular shape along a peripheral edge portion of the second surface portion 20*b*, a bottom-portion filling portion 73 formed into a circular shape along a peripheral edge portion of the bottom portion 13, and a top-portion filling portion 74 formed into a circular shape around the outlet cylinder portion 15*a* in the top portion 14.

A lower edge of the first body-portion filling portion 71 is connected to a front edge of the bottom-portion filling portion 73, and a lower edge of the second body-portion filling portion 72 is connected to a rear edge of the bottom-portion filling portion 73. A central portion of an upper end portion of the first body-portion filling portion 71 in the widthwise direction is connected to a central portion of a front-end portion of the top-portion filling portion 74 in the widthwise direction.

The sheet member container 100 includes the filling portion 70 with such a structure, and accordingly, structural strength is sufficiently achieved substantially over the whole container main body 20.

In the case of this exemplary embodiment, the whole filling portion 70 is formed in an integrated manner. Here, a connecting portion 67 between the first body-portion filling portion 71 and the top-portion filling portion 74 is narrowed. That is, a connecting portion 24*a* (see FIG. 7) that is a portion forming the connecting portion 67 in the non-attached region 24 is narrowed.

In addition, in the present invention, the sheet member container 100 may include a plurality of filling portions 70 that are independent of each other.

Alternatively, the filling portion 70 does not necessarily have to be formed in the whole non-attached region 24, and may be formed in some of a plurality of non-attached regions 24.

In the case of this exemplary embodiment, each of the outer film layer 22 and the inner film layer 23 has a layer structure including a plurality of resin layers. Also, the inner-bag forming sheet member 41 has a layer structure including a plurality of resin layers.

The main-body forming sheet member 21 preferably includes the resin layer of at least one type of polyethylene, polypropylene, polyester, and polyamide.

A material of the resin layer that forms the outer film layer 22 and the inner film layer 23 of the main-body forming sheet member 21 is not specifically limited. For example, the material is preferably one of a polyethylene material such as high density polyethylene (HDPE), medium density polyethylene (MDPE), low density polyethylene (LDPE), linear low-density polyethylene (LLDPE), ultralow density polyethylene (ULDPE) or ethylene-vinyl alcohol copolymer (EVOH); a polypropylene material such as oriented polypropylene (OPP), cast polypropylene (CPP), isotactic PP, syndiotactic PP, atactic PP, random PP or block PP; a polyester material such as polyethylene terephthalate (PET), amorphous polyethylene terephthalate (amorphous PET), polybutylene terephthalate (PBT), polyethylene naphthalate (PEN) or polybutylene naphthalate (PBN); and a polyamide material such as oriented nylon (ONy), cast nylon (CNy), nylon 6, nylon 66, nylon 11, nylon 12 or MXD6. Of these materials, the above polyethylene material is especially preferable.

As one example, the outer film layer 22 has a four-layer structure formed by stacking four resin layers of a first layer, a second layer, a third layer, and a fourth layer in this order.

Of these layers, the first layer forms an external surface of the container main body 20. The first layer includes, for example, polyethylene terephthalate (PET) or oriented nylon (ONy). The main function of the first layer is to provide the container main body 20 with a feeling of gloss and printability, and to provide the container main body 20 with rigidity.

The second layer is, for example, a layer of transparent deposition PET including polyethylene terephthalate obtained through vapor deposition of silica and/or alumina on a surface of this second layer on the first layer side. The main function of the second layer is to provide the container main body 20 with a gas barrier property.

The third layer includes, for example, oriented nylon. The main function of the third layer is to provide the container main body 20 with a pinhole resistance.

The fourth layer includes, for example, linear low-density polyethylene (LLDPE). The main function of the fourth layer is to achieve a heat seal property with the inner film layer 23.

An example of the layer structure of the inner film layer 23 is a structure including a fifth layer including, for example, linear low-density polyethylene (LLDPE) in addition to a layer structure similar to the outer film layer 22 including the first layer to the fourth layer. The fifth layer is adjacent to the first layer, and forms a surface opposite to the fourth layer in the inner film layer 23. The main function of the fifth layer is to achieve a heat seal property with the outer film layer 22.

The main function of the fourth layer of the inner film layer 23 is to achieve a heat seal property with the inner-bag forming sheet member 41.

However, the layer structure of the outer film layer 22 and the inner film layer 23 is not limited to the above example, and the material of each of the layers that form the outer film layer 22 and the inner film layer 23 is not limited to the examples described above.

As one example, the inner-bag forming sheet member 41 that constitutes the inner bag 40 has a three-layer structure constituted by stacking a first layer, a second layer and a third layer in this order.

Of these layers, the first layer includes, for example, linear low-density polyethylene. The main function of the first layer is to achieve a heat seal property (heat seal property with the inner film layer 23) with the main-body forming sheet member 21.

The second layer is, for example, a layer of transparent deposition oriented nylon including oriented nylon obtained through vapor deposition of silica and/or alumina on a surface of this second layer on the first layer side. The main function of the second layer is to achieve a gas barrier property and a pinhole resistance.

The third layer includes, for example, linear low-density polyethylene. The main function of the third layer is to achieve a heat seal property of the inner-bag forming sheet member 41.

In addition, the layer structure of the inner-bag forming sheet member 41 is not limited to the structure that has been described here.

As illustrated in FIG. 6, the inner-bag forming sheet member 41 is stacked to the main-body forming sheet member 21, and as illustrated in FIG. 7, a peripheral edge portion of the inner film layer 23 and a peripheral edge portion of the inner-bag forming sheet member 41 are attached to each other, and a peripheral edge portion of the outer film layer 22 and the peripheral edge portion of the inner film layer 23 are attached to each other. Consequently, the main-body forming sheet member 21 and the inner-bag forming sheet member 41 constitute a container forming sheet member 51.

A sealing portion of a peripheral edge portion of the container forming sheet member 51 is referred to as a peripheral edge sealing portion 52. The peripheral edge sealing portion 52 includes a sealing portion (below, an inner-outer sealing portion 43) between the peripheral edge portion of the inner film layer 23 and the peripheral edge portion of the inner-bag forming sheet member 41, and a sealing portion (below, a main-body peripheral edge sealing portion 28) between the peripheral edge portion of the outer film layer 22 and the peripheral edge portion of the inner film layer 23.

FIG. 7 illustrates a region in which the peripheral edge sealing portion 52 is formed, with hatching rising to the left. Also, in FIG. 7, hatching rising to the left and hatching rising to the right are overlapped in a region where the region in which the peripheral edge sealing portion 52 is formed overlaps with a region in which the main-body sealing portion 26 is formed.

As for a method of forming the peripheral edge sealing portion 52, heat sealing, ultrasonic sealing, attaching with adhesive or the like may be used as an example.

As illustrated in FIG. 7, the main-body forming sheet member 21 includes, for example: a first sheet portion 31 that is a portion constituting the first surface portion 20*a*; a second sheet portion 32 that is a portion constituting the second surface portion 20*b*; a bottom-portion forming sheet portion 38 that is a portion constituting the bottom portion 13; a top-portion forming sheet portion 39 that is a portion constituting the top portion 14; and an extending portion 25 having a rectangular shape in plane view. For example, the extending portion 25 extends outward from the second sheet portion 32.

An insert hole 21*a* into which the outlet cylinder portion 15*a* of the spout member 15 is inserted is formed in the top-portion forming sheet portion 39.

In the case of this exemplary embodiment, the inner-bag forming sheet member 41 is formed into the same shape as in a portion of the main-body forming sheet member 21 excluding the extending portion 25.

In addition, FIG. 6 illustrates a seal boundary line 41*a* of the inner-bag forming sheet member 41, with a dashed line for convenience. The seal boundary line 41*a* is a boundary line between a region in which the inner-bag forming sheet member 41 is attached (sealed) to the main-body forming sheet member 21 and another region in the inner-bag forming sheet member 41, and is a boundary line between a region in which portions of the inner-bag forming sheet member 41 are attached to each other and the other region in the inner-bag forming sheet member 41 when the sheet member container 100 is formed (formed into the bag) by using the container forming sheet member 51.

In the case of this exemplary embodiment, a position of the seal boundary line 41*a* and a position of the seal boundary line 21*c* correspond to each other (overlap with each other).

An insert hole 41*b* into which the outlet cylinder portion 15*a* of the spout member 15 is inserted is formed in a portion of the inner-bag forming sheet member 41 that overlaps with the top-portion forming sheet portion 39.

The plate shape portion 15*b* of the spout member 15 is attached to, for example, an inner surface of a portion of the inner-bag forming sheet member 41 that overlaps with the top-portion forming sheet portion 39, and a peripheral edge of the insert hole 41*b* forms the peripheral edge sealing portion 52 to which the inner-bag forming sheet member 41, the main-body forming sheet member 21 and the plate shape portion 15*b* are attached. The outlet cylinder portion 15*a* is caused to pass through the insert hole 41*b* of the inner-bag forming sheet member 41 and the insert hole 21*a* of the top-portion forming sheet portion 39, and protrudes toward the external surface side of these sheets.

Peripheral edge portions of the container forming sheet member 51 (the inner-bag forming sheet member 41) are attached to each other in a state where the folding line 101, the folding line 102, and the folding line 104 illustrated in FIG. 7 are folded as valley fold, and the folding line 103 and the folding line 105 are folded as mountain fold. With this operation, the container forming sheet member 51 is formed into a bag shape with a double structure (see FIG. 8).

Figure 4A:
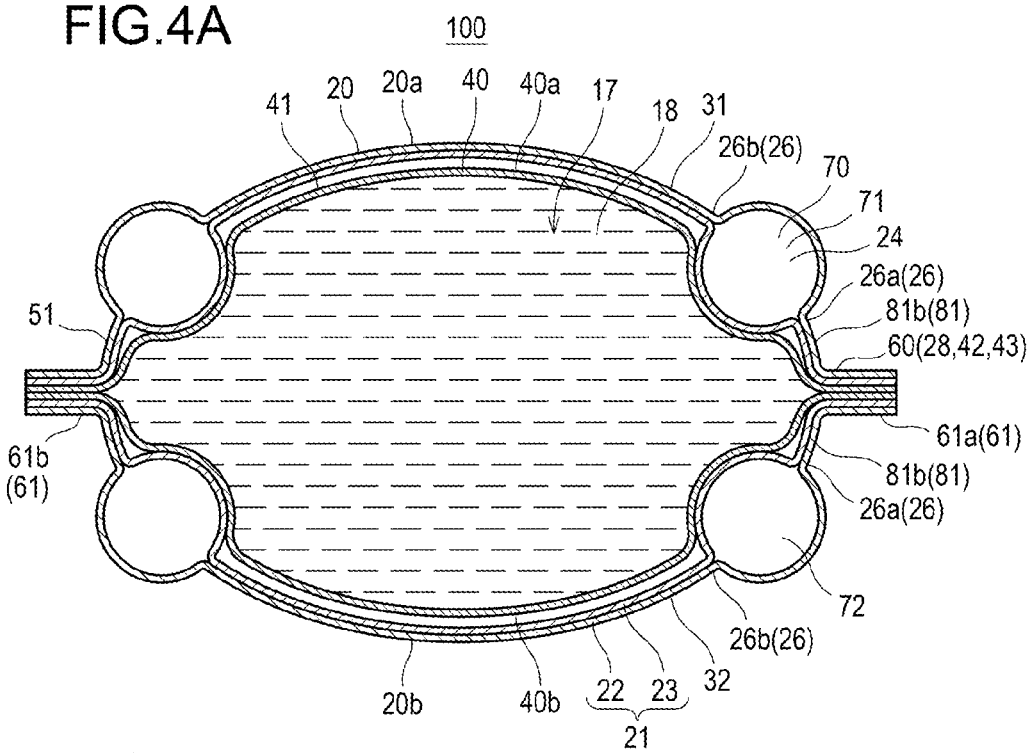
FIG. 4A and FIG. 4B are cross-sectional views taken along the A-A line in FIG. 1.

That is, edge portions of the inner-bag forming sheet member 41 are attached to each other to form an inner-bag sealing portion 42 (see FIG. 4A and FIG. 6). Thus, using the inner-bag forming sheet member 41, the inner bag 40 is formed. In addition, the bag-shaped container main body 20 (see FIG. 8) that covers the inner bag 40 is formed.

As for a method of attaching portions of the inner-bag forming sheet member 41 to each other, heat sealing, ultrasonic sealing, attaching with adhesive or the like may be used as an example.

In the case of this exemplary embodiment, the main-body peripheral edge sealing portion 28, the inner-bag sealing portion 42 and the inner-outer sealing portion 43 are arranged at positions that correspond to one another (positions that overlap with one another). The main-body peripheral edge sealing portion 28, the inner-bag sealing portion 42 and the inner-outer sealing portion 43 are generically referred to as the peripheral edge sealing portion 60 (the peripheral edge sealing portion 60 includes the main-body peripheral edge sealing portion 28, the inner-bag sealing portion 42 and the inner-outer sealing portion 43). That is, a sealing portion of a peripheral edge portion of the sheet member container 100 formed into the bag is referred to as the peripheral edge sealing portion 60 (see FIG. 8).

Figure 8:
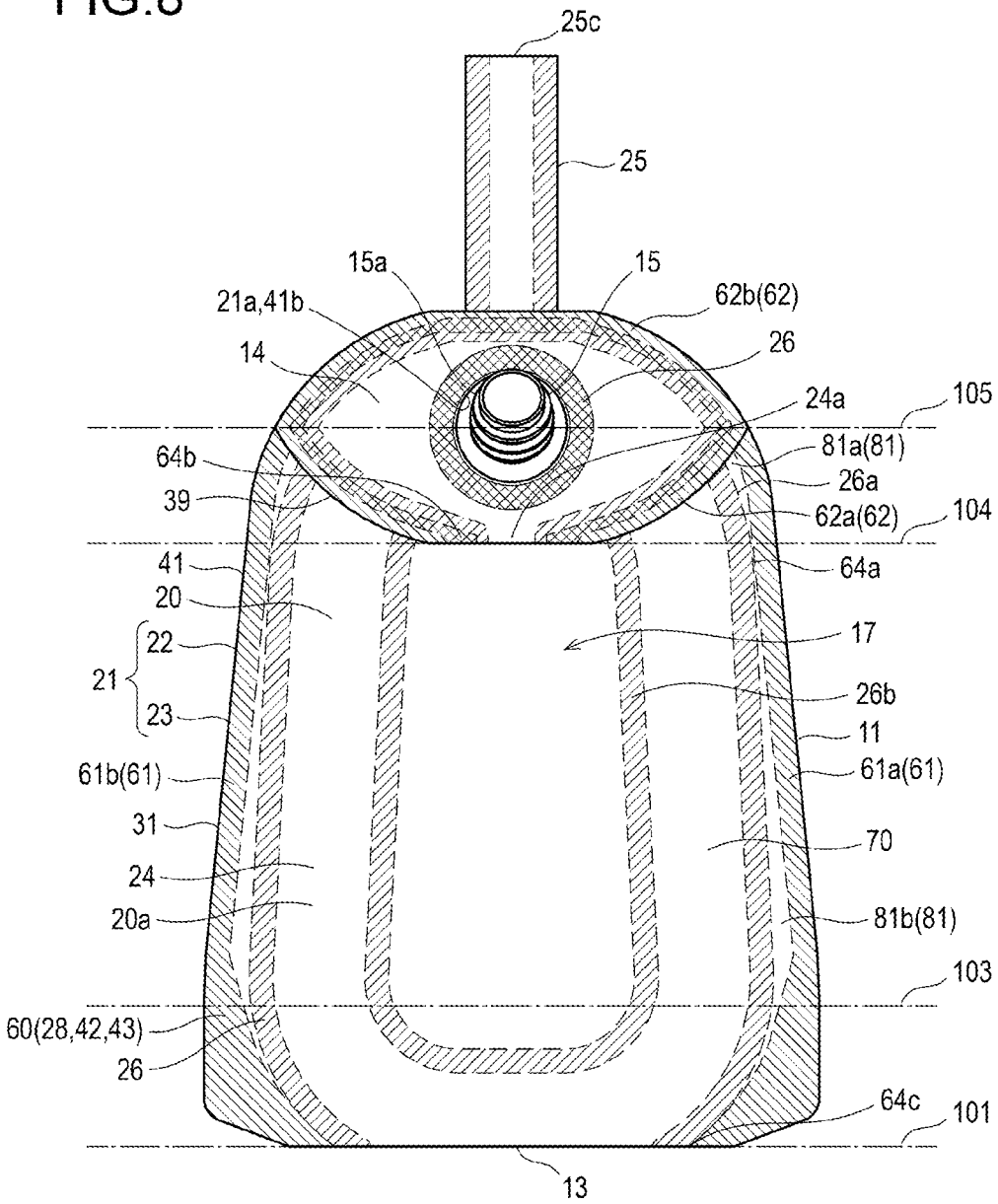
FIG. 8 is a front view illustrating the sheet member container according to the first exemplary embodiment in a state before the filler is contained in a filling portion.

FIG. 8 illustrates a region in which the peripheral edge sealing portion 60 is formed, with hatching rising to the left. Also, in FIG. 8, hatching rising to the left and hatching rising to the right are overlapped in a region where the region in which the peripheral edge sealing portion 60 is formed overlaps with the region in which the main-body sealing portion 26 is formed. Further, FIG. 1 and FIG. 2 also illustrate the region in which the peripheral edge sealing portion 60 is formed, with hatching rising to the left.

A portion of the first sheet portion 31 on a top-portion forming sheet portion 39 side of the folding line 105 is a first overlapping portion 31*a*. The first overlapping portion 31*a* is disposed to overlap with one half portion in the top-portion forming sheet portion 39 in a state before the filler is contained in the non-attached region 24.

A portion of the second sheet portion 32 that is located away from the bottom-portion forming sheet portion 38 via a folding line 106 is a second overlapping portion 32*a*. The second overlapping portion 32*a* is disposed to overlap with the other half portion in the top-portion forming sheet portion 39 in the state before the filler is contained in the non-attached region 24.

As illustrated in FIG. 8, the container forming sheet member 51 is formed into a double bag shape, to obtain a container. In the container, for example, the filler is inputted from an inlet port 25*c* formed in the extending portion 25 into the non-attached region 24. Afterward, the non-attached region 24 is sealed at a portion continuously connected to a base end side of the extending portion 25. This causes the filler to be contained in the non-attached region 24 (the filling portion 70).

In addition, a pressure within the filling portion 70 is not specifically limited. However, it is preferable that this pressure is higher than atmospheric pressure, and for example, can be set to be equal to or more than 10 kPa and equal to or less than 500 kPa (gauge pressure).

That is, the filling portion capable of containing the filler is a space located between layers of the outer film layer 22 and the inner film layer 23, and capable of holding sealability when the filler is contained substantially at a pressure in a range of equal to or more than 10 kPa and equal to or less than 500 kPa.

After formation of the filling portion 70 in which the filler is contained, the extending portion 25 is cut off, for example.

In this manner, the sheet member container 100 in which the filler is contained is obtained (see FIG. 1 and FIG. 2). Alternatively, the extending portion 25 may remain even in a state of the sheet member container 100 in which the filler is contained.

After the sheet member container 100 is manufactured, the contents 18 are inputted through the outlet cylinder portion 15*a* of the spout member 15 into the containing portion 17. Afterward, the cap portion 90 is mounted to the spout member 15. This makes it possible to obtain the sheet member container 100 in which the contents 18 are contained in the containing portion 17.

In the case of this exemplary embodiment, as illustrated in FIG. 1 to FIG. 3, the peripheral edge sealing portion 60 includes, for example, a top-portion peripheral edge sealing portion 62 disposed along a peripheral edge of the top portion 14, the side edge sealing portion 61 extending along a side edge of the body portion 11 in an up-down direction, and a bottom-portion peripheral edge sealing portion 63 disposed along a peripheral edge of the bottom portion 13.

The top-portion peripheral edge sealing portion 62 includes a first-surface-portion-side top-portion peripheral edge sealing portion 62*a* disposed along a boundary between the top portion 14 and the first surface portion 20*a*, and a second-surface-portion-side top-portion peripheral edge sealing portion 62*b* disposed along a boundary between the top portion 14 and the second surface portion 20*b*.

The side edge sealing portion 61 includes a side edge sealing portion 61*a* disposed along a right-side edge of the body portion 11, and a side edge sealing portion 61*b* disposed along a left-side edge of the body portion 11.

The bottom-portion peripheral edge sealing portion 63 includes a bottom-portion peripheral edge sealing portion 63*a* disposed along a right-side edge of the bottom portion 13, and a bottom-portion peripheral edge sealing portion 63*b* disposed along a left-side edge of the bottom-portion peripheral edge sealing portion 63.

An upper end of the right-side edge sealing portion 61*a* is connected to a right end portion of the top-portion peripheral edge sealing portion 62, and an upper end of the left-side edge sealing portion 61*b* is connected to a left end portion of the top-portion peripheral edge sealing portion 62. A lower end of the right-side edge sealing portion 61*a* is connected to a central portion of the right bottom-portion peripheral edge sealing portion 63*a* in a front-rear direction, and a lower end of the left-side edge sealing portion 61*b* is connected to a central portion of the left bottom-portion peripheral edge sealing portion 63*b* in the front-rear direction.

Each of the side edge sealing portions 61*a* and 61*b* is constituted, for example, by attaching a side edge portion of the first sheet portion 31 and a side edge portion of the second sheet portion 32 to each other (via the inner-bag forming sheet member 41). The first-surface-portion-side top-portion peripheral edge sealing portion 62*a* is constituted by attaching the half portion of the top-portion forming sheet portion 39 on a first sheet portion 31 side and an upper end portion of the first sheet portion 31 to each other (via the inner-bag forming sheet member 41). The second-surface-portion-side top-portion peripheral edge sealing portion 62*b* is constituted by attaching the half portion of the top-portion forming sheet portion 39 on a second sheet portion 32 side and an upper end portion of the second sheet portion 32 to each other (with the inner-bag forming sheet member 41 being interposed therebetween).

Also, a half portion of a right-side edge portion of the bottom-portion forming sheet portion 38 on the first sheet portion 31 side and a lower end portion of a right-side edge portion of the first sheet portion 31 are attached to each other (via the inner-bag forming sheet member 41) to constitute a front lower sheet piece 75*a*, and a half portion of the right-side edge portion of the bottom-portion forming sheet portion 38 on the second sheet portion 32 side and a lower end portion of a right-side edge portion of the second sheet portion 32 are attached to each other (via the inner-bag forming sheet member 41) to constitute a rear lower sheet piece 75*b*. Then, the front lower sheet piece 75*a* and the rear lower sheet piece 75*b* are partially attached to each other, to constitute an integrated skirt portion 75 in the container main body 20.

Similarly, a half portion of a left-side edge portion of the bottom-portion forming sheet portion 38 on the first sheet portion 31 side and a lower end portion of a left-side edge portion of the first sheet portion 31 are attached to each other (via the inner-bag forming sheet member 41) to constitute a front lower sheet piece 75*a*, and a half portion of the left-side edge portion of the bottom-portion forming sheet portion 38 on the second sheet portion 32 side and a lower end portion of a left-side edge portion of the second sheet portion 32 are attached to each other (via the inner-bag forming sheet member 41) to constitute a rear lower sheet piece 75*b*. Then, the front lower sheet piece 75*a* and the rear lower sheet piece 75*b* are attached to each other, to constitute an integrated skirt portion 75. Each of left and right skirt portions 75 is the bottom-portion peripheral edge sealing portion 63.

The bottom-portion peripheral edge sealing portion 63 (the skirt portion 75) is formed in a substantially isosceles triangular shape with a vertex shared by two equal sides being disposed on the upper side, for example, in side view. An upper end (the above vertex) of the bottom-portion peripheral edge sealing portion 63 (the skirt portion 75) is connected to a lower end of the side edge sealing portion 61 (see FIG. 2).

In the case of this exemplary embodiment, as an example, one or a plurality of sheet members are attached to each other in an entire region on an inner side of an external line of the bottom-portion peripheral edge sealing portion 63 (the above-described substantially isosceles triangular shape).

Alternatively, a portion in which peripheral edge portions of the one or plurality of sheet members are not attached to each other may be formed in a region on the inner side of the external line of the bottom-portion peripheral edge sealing portion 63. More specifically, the bottom-portion peripheral edge sealing portion 63 may include, for example, a first portion extending vertically downward from the lower end of the side edge sealing portion 61, and a second portion and a third portion each extending from the lower end of the side edge sealing portion 61 along each of two equal sides (oblique sides) of the above-described substantially isosceles triangular shape. In the skirt portion 75, the peripheral edge portions of the one or plurality of sheet members are not attached to each other in a region disposed between the first portion and the second portion and a region disposed between the first portion and the third portion.

In this manner, a portion where the outer film layer 22 and the inner film layer 23 are not attached to each other in the region on the inner side of the external line of the bottom-portion peripheral edge sealing portion 63 can be an escape place of air trapped when the bottom-portion peripheral edge sealing portion 63 is formed.

In the case of this exemplary embodiment, the bottom portion 13 includes a bottom surface of the container main body 20, the skirt portion 75, and a portion covered with the skirt portion 75.

In the case of this exemplary embodiment, for example, the film layer constituting the main-body forming sheet member 21 and the inner-bag forming sheet member 41 are not attached in the second non-attached region 81.

Preferably, the film layers that form the sheet member container 100 are all not attached in the second non-attached region 81. Consequently, the side edge portion 12 of the body portion 11 has a structure with a favorable flexibility, and hence texture of the side edge portion 12 softens.

Figure 4B:
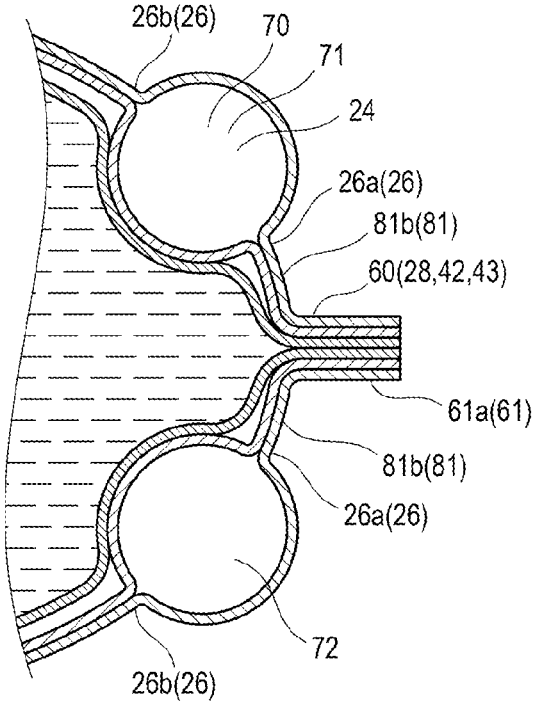

More specifically, as illustrated in FIG. 4A and FIG. 4B, the outer film layer 22 and the inner film layer 23 are not attached and the inner film layer 23 and the inner-bag forming sheet member 41 are not attached in the second non-attached region 81. That is, in the second non-attached region 81, a portion of the outer film layer 22, a portion of the inner film layer 23, a portion of the inner-bag forming sheet member 41, another portion of the inner-bag forming sheet member 41, another portion of the inner film layer 23 and another portion of the outer film layer 22 are not attached to each other, and are stacked in this order.

In the peripheral edge sealing portion 60, film layers adjacent to each other in the film layers forming the sheet member container 100 are all attached to each other. This can maintain the sheet member container 100 in a desired shape.

More specifically, in the peripheral edge sealing portion 60, the outer film layer 22 and the inner film layer 23 are attached to each other, and the inner film layer 23 and the inner-bag forming sheet member 41 are attached to each other. That is, in the peripheral edge sealing portion 60, a portion of the outer film layer 22, a portion of the inner film layer 23, a portion of the inner-bag forming sheet member 41, another portion of the inner-bag forming sheet member 41, another portion of the inner film layer 23 and another portion of the outer film layer 22 are stacked in this order and are attached to each other.

As illustrated in FIG. 6, the main-body sealing portion 26 is disposed on an inner side of the peripheral edge sealing portion 60, excluding after-mentioned portions that are seal continuity portions 64*a*, 64*b* and 64*c*.

In the case of this exemplary embodiment, the main-body sealing portion 26 includes, for example, an outer peripheral side main-body sealing portion 26*a* formed in a circular shape along the peripheral edge portion of the main-body forming sheet member, and a plurality of (for example, four) inner peripheral side main-body sealing portions 26*b* arranged on an inner side of the outer peripheral side main-body sealing portion 26*a*.

The outer peripheral side main-body sealing portion 26 is formed, for example, in a series over the first sheet portion 31, the second sheet portion 32, the bottom-portion forming sheet portion 38, and the top-portion forming sheet portion 39.

More specifically, as illustrated in FIG. 7, a portion of the outer peripheral side main-body sealing portion 26*a* that is formed in the top-portion forming sheet portion 39 is disposed along the top-portion peripheral edge sealing portion 62. Respective portions of the outer peripheral side main-body sealing portion 26*a* that are formed in the first sheet portion 31 and the second sheet portion 32 are arranged along the side edge sealing portion 61. A portion of the outer peripheral side main-body sealing portion 26*a* that is formed in the bottom-portion forming sheet portion 38 is disposed along the bottom-portion peripheral edge sealing portion 63.

The inner peripheral side main-body sealing portions 26*b* are formed, for example, in the first sheet portion 31, the second sheet portion 32, the bottom-portion forming sheet portion 38, and the top-portion forming sheet portion 39, respectively.

The outer peripheral side main-body sealing portion 26*a* is formed, for example, into an annular shape. Each inner peripheral side main-body sealing portion 26*b* is formed, for example, into an annular shape.

The non-attached region 24 (filling portion 70) is a closed region defined by the outer peripheral side main-body sealing portion 26*a* and a plurality of inner peripheral side main-body sealing portions 26*b*, in a state where the filler is contained.

The second non-attached region 81 is a closed region defined by the outer peripheral side main-body sealing portion 26*a* and the peripheral edge sealing portion 60.

In the case of this exemplary embodiment, for example, the second non-attached region 81 is disposed between the side edge sealing portion 61 and the main-body sealing portion 26 in each of a pair of side edge portions 12 of the body portion 11.

Consequently, each of the pair of side edge portions 12 of the body portion 11 has the structure with the favorable flexibility, and hence texture when the user grips the sheet member container 100 can be softer.

More specifically, the second non-attached region 81 is disposed between the side edge sealing portion 61*a* and a right-side edge of the outer peripheral side main-body sealing portion 26*a*, and the second non-attached region 81 is also disposed between the side edge sealing portion 61*b* and a left-side edge of the main-body sealing portion 26.

Also, in the case of this exemplary embodiment, as illustrated in FIG. 2, the second non-attached region 81 is disposed between the side edge sealing portion 61 and the main-body sealing portion 26 in each of the first surface portion 20*a* and the second surface portion 20*b*.

Consequently, even when the user grips the sheet member container 100 from one of the front surface side (a first surface portion 20*a* side) and the back surface side (a second surface portion 20*b* side) of the container, a portion in the side edge portion 12 that corresponds to the second non-attached region 81 naturally touches the user's fingers and palm.

More specifically, the second non-attached region 81 is disposed between the side edge sealing portion 61 and the outer peripheral side main-body sealing portion 26*a* on the first surface portion 20*a* side, and the second non-attached region 81 is also disposed between the side edge sealing portion 61 and the outer peripheral side main-body sealing portion 26*a* on the second surface portion 20*b* side.

In the case of this exemplary embodiment, for example, a plurality of second non-attached regions 81 arranged away from each other in the direction in which the side edge sealing portion 61 extends are formed in the body portion 11. More specifically, the plurality of second non-attached regions 81 are, for example, arranged away from each other in the up-down direction in the body portion 11.

Consequently, the side edge portion 12 of the body portion 11 partially has the structure with the favorable flexibility, and hence the texture of the side edge portion 12 can be softened.

More specifically, for example, the seal continuity portion 64*a* in which the side edge sealing portion 61 is connected to the main-body sealing portion 26 is disposed above a central position of the body portion 11 in a height direction. The seal continuity portion 64*a* includes a mode in which the side edge sealing portion 61 and the main-body sealing portion 26 are connected in an overlapped state, and a mode in which the side edge sealing portion 61 and the main-body sealing portion 26 are connected (adjacent) without overlapping. Then, the second non-attached regions 81 are arranged on an upper side and a lower side of the seal continuity portion 64*a*, respectively. Consequently, the sheet member container 100 has a structure with a relatively soft portion in a portion of the side edge portion 12 and a relatively hard portion in another portion of the side edge portion 12. Therefore, it is possible to sufficiently achieve the structural strength of the sheet member container 100 and make the favorable texture of the side edge portion 12 improved.

More specifically, the second non-attached region 81 includes a second non-attached region 81*a* (below, the upper second non-attached region 81*a*) disposed on the upper side of the seal continuity portion 64*a* as a basis, and a second non-attached region 81*b* disposed on the lower side thereof (below, the lower second non-attached region 81*b*). A lower end of the upper second non-attached region 81*a* is connected to an upper end of the seal continuity portion 64*a*, and an upper end of the lower second non-attached region 81*b* is connected to a lower end of the seal continuity portion 64*a*. In other words, the upper second non-attached region 81*a* is separated from the lower second non-attached region 81*b* by the seal continuity portion 64*a* in the up-down direction.

In the seal continuity portion 64*a*, film layers disposed adjacent to each other in a thickness direction in the film layers forming the sheet member container 100 are all attached. That is, in the seal continuity portion 64*a*, a portion of the outer film layer 22, a portion of the inner film layer 23, a portion of the inner-bag forming sheet member 41, another portion of the inner-bag forming sheet member 41, another portion of the inner film layer 23 and another portion of the outer film layer 22 are stacked in this order and attached to each other.

As illustrated in FIG. 2, for example, the second non-attached region 81 (for example, the upper second non-attached region 81*a*) extends continuously over from a position above a top-portion-side intersection point 65 between an upper end of the side edge sealing portion 61 and the top-portion peripheral edge sealing portion 62 to a position below the top-portion-side intersection point 65. In other words, the second non-attached region 81 extends across the top-portion-side intersection point 65 in the up-down direction. Consequently, the sheet member container 100 has a structure with a relatively soft portion around a portion where the top-portion peripheral edge sealing portion 62 intersects the side edge sealing portion 61. Therefore, the texture of the sheet member container 100 can be softer.

More specifically, in the case of this exemplary embodiment, the top-portion-side intersection point 65 includes a top-portion-side intersection point 65*a* between the upper end of the side edge sealing portion 61*a* and the right end portion of the top-portion peripheral edge sealing portion 62, and a top-portion-side intersection point (not shown in the drawing) between the upper end of the side edge sealing portion 61*b* and the left end portion of the top-portion peripheral edge sealing portion 62.

The right top-portion-side intersection point 65*a* is an intersection point among a right end of the first-surface-portion-side top-portion peripheral edge sealing portion 62*a*, a right end of the second-surface-portion-side top-portion peripheral edge sealing portion 62*b*, and the upper end of the side edge sealing portion 61*a*.

The left top-portion-side intersection point is an intersection point among a left end of the first-surface-portion-side top-portion peripheral edge sealing portion 62*a*, a left end of the second-surface-portion-side top-portion peripheral edge sealing portion 62*b*, and the upper end of the side edge sealing portion 61*b*.

Here, it is preferable that a width of the second non-attached region 81 (for example, the upper second non-attached region 81*a*) is largest at a position of the top-portion-side intersection point 65 in the height direction. In this exemplary embodiment, the width is a length of the sheet member container 100 in a horizontal direction in a state where the bottom portion 13 of the container is mounted on a horizontal plane.

Consequently, the sheet member container 100 has the structure with the relatively softer portion around the portion where the top-portion peripheral edge sealing portion 62 intersects the side edge sealing portion 61. Therefore, the texture of the sheet member container 100 can be further soft.

As illustrated in FIG. 2, it is preferable that the width of the second non-attached region 81 is largest at the position of the top-portion-side intersection point 65 in the height direction in the state where the filler is contained in the filling portion 70 in side view. Also, it is preferable that the width of the second non-attached region 81 is largest at the position of the top-portion-side intersection point 65 in the height direction in front view. More preferably, the width of the second non-attached region 81 is largest at the position of the top-portion-side intersection point 65 in the height direction in both of side view and front view.

Further, as illustrated in FIG. 2, the second non-attached region 81 (the lower second non-attached region 81*b*) extends continuously over from a position above a bottom-portion-side intersection point 66 that is an intersection point between a lower end of the side edge sealing portion 61 and the bottom-portion peripheral edge sealing portion 63 to a position below the bottom-portion-side intersection point 66. In other words, the second non-attached region 81 extends across the bottom-portion-side intersection point 66 in the up-down direction. Consequently, the sheet member container 100 has the structure with the relatively soft portion around a portion where the bottom-portion peripheral edge sealing portion 63 intersects the side edge sealing portion 61. Therefore, the texture of the sheet member container 100 can be softer.

More specifically, in the case of this exemplary embodiment, the bottom-portion-side intersection point 66 includes a bottom-portion-side intersection point 66*a* between the lower end of the side edge sealing portion 61*a* and a right end portion of the bottom-portion peripheral edge sealing portion 63, and a bottom-portion-side intersection point (not shown in the drawing) between the lower end of the side edge sealing portion 61*b* and a left end portion of the bottom-portion peripheral edge sealing portion 63.

The right bottom-portion-side intersection point 66*a* is an intersection point between the central portion of the bottom-portion peripheral edge sealing portion 63*a* in the front-rear direction and the lower end of the side edge sealing portion 61*a*.

The left bottom-portion-side intersection point is an intersection point between the central portion of the bottom-portion peripheral edge sealing portion 63*b* in the front-rear direction and the upper end of the side edge sealing portion 61*b*.

Also, it is preferable that the width of the second non-attached region 81 (for example, the lower second non-attached region 81*b*) is largest at a position of the bottom-portion-side intersection point 66 in the height direction.

Consequently, the sheet member container 100 has the structure with the relatively softer portion around a portion where the bottom-portion peripheral edge sealing portion 63 intersects the side edge sealing portion 61. Therefore, the texture of the sheet member container 100 can be further soft.

As illustrated in FIG. 2, it is preferable that the width of the second non-attached region 81 is largest at the position of the bottom-portion-side intersection point 66 in the height direction in the state where the filler is contained in the filling portion 70 in side view. Also, it is preferable that the width of the second non-attached region 81 is largest at the position of the bottom-portion-side intersection point 66 in the height direction in front view. More preferably, the width of the second non-attached region 81 is largest at the position of the bottom-portion-side intersection point 66 in the height direction in both of side view and front view.

Therefore, on the basis of the top-portion-side intersection point 65, a lower part of the upper second non-attached region 81*a* is defined by a portion of the side edge sealing portion 61 and a portion of the outer peripheral side main-body sealing portion 26*a*, and an upper part of the upper second non-attached region 81*a* is defined by a portion of the top-portion peripheral edge sealing portion 62 and a portion of the outer peripheral side main-body sealing portion 26*a*.

On the basis of the bottom-portion-side intersection point 66, an upper part of the lower second non-attached region 81*b* is defined by a portion of the side edge sealing portion 61 and a portion of the outer peripheral side main-body sealing portion 26*a*. Additionally, the lower part of the lower second non-attached region 81*b* is defined by a portion of the bottom-portion peripheral edge sealing portion 63 and a portion of the outer peripheral side main-body sealing portion 26*a*.

In the case of this exemplary embodiment, as described above, the second non-attached region 81 includes the upper second non-attached region 81*a* and the lower second non-attached region 81*b*. In this case, in the height direction, the width of the upper second non-attached region 81*a* at the position of the top-portion-side intersection point 65 may be equal to the width of the lower second non-attached region 81*b* at the position of the bottom-portion-side intersection point 66, and one of the widths may be larger than the other width.

Also, the sheet member container 100 further includes, for example, the seal continuity portion 64*b* disposed in a central portion of an upper end portion of the body portion 11 in a lateral direction, and the seal continuity portions 64*c* arranged at a right end and a left end of a lower end portion of the body portion 11, respectively.

The seal continuity portion 64*b* is, for example, formed in the upper end portion of the body portion 11 on each of the first surface portion 20*a* side and the second surface portion 20*b* side. The seal continuity portion 64*c* is, for example, formed in the lower end portion of the body portion 11 on each of the first surface portion 20*a* side and the second surface portion 20*b* side.

The seal continuity portion 64*b* is, for example, formed as illustrated in FIG. 1 so that a central portion of the top-portion peripheral edge sealing portion 62 in the lateral direction is connected to a portion of the corresponding outer peripheral side main-body sealing portion 26*a*. In addition, the connecting portion 24*a* described above is formed in a central portion of the seal continuity portion 64*b* formed on the first surface portion 20*a* side in the lateral direction, and in the central portion, the outer film layer 22 and the inner film layer 23 are not attached to each other.

For example, as illustrated in FIG. 2, the seal continuity portion 64*c* is formed in the body portion 11 on the first surface portion 20*a* side so that a front end of the bottom-portion peripheral edge sealing portion 63 is connected to a portion of the corresponding main-body sealing portion 26. The seal continuity portion 64*c* is, for example, formed in the body portion 11 on the second surface portion 20*b* side so that a rear end of the bottom-portion peripheral edge sealing portion 63 is connected to a portion of the corresponding main-body sealing portion 26.

The second non-attached region 81 (upper second non-attached region 81*a*) on the upper side of the seal continuity portion 64*a* includes, for example, a portion with a width gradually decreasing toward the seal continuity portion 64*a*. More specifically, a separation distance between a portion of the side edge sealing portion 61 that defines the upper second non-attached region 81*a* and a portion of the outer peripheral side main-body sealing portion 26*a* that defines the upper second non-attached region 81*a* gradually decreases toward downside (the seal continuity portion 64*a*). Consequently, even if there is an impact on the sheet member container 100 due to the falling or the like, the impact on the seal continuity portion 64*a* can be reduced. It is therefore possible to favorably maintain a state where the film layers adjacent to each other or the resin layers forming the respective film layers are attached to each other in the seal continuity portion 64*a*.

Also, the upper second non-attached region 81*a* includes, for example, a portion with a width gradually decreasing toward the seal continuity portion 64*b*. More specifically, a separation distance between a portion of the top-portion peripheral edge sealing portion 62 that defines the upper second non-attached region 81*a* and a portion of the outer peripheral side main-body sealing portion 26*a* that defines the upper second non-attached region 81*a* gradually decreases toward upside (the seal continuity portion 64*b*). Consequently, even if there is an impact on the sheet member container 100 (due to the falling or the like), the impact on the seal continuity portion 64*b* can be reduced.

The second non-attached region 81 has a width gradually decreasing from the position of the top-portion-side intersection point 65 toward the seal continuity portion 64*a*. More specifically, the width of the upper second non-attached region 81*a* gradually decreases from the position of the top-portion-side intersection point 65 toward the seal continuity portion 64*a*.

Consequently, even if there is an impact on the sheet member container 100 (due to the falling or the like), the impact on the seal continuity portion 64*a* can be more reduced. It is therefore possible to further favorably maintain the state where the film layers adjacent to each other or the resin layers forming the respective film layers are attached to each other.

Also, the second non-attached region 81 has, for example, a width gradually decreasing from the position of the top-portion-side intersection point 65 toward the upside. More specifically, the width gradually decreases from the position of the top-portion-side intersection point 65 toward the seal continuity portion 64*b*.

Consequently, even if there is an impact on the sheet member container 100 (due to the falling or the like), the impact on the seal continuity portion 64*b* can be more reduced. It is therefore possible to further favorably maintain the state where the film layers adjacent to each other or the resin layers forming the respective film layers are attached to each other.

Similarly, the second non-attached region 81 (lower second non-attached region 81*b*) on the lower side of the seal continuity portion 64*a* includes, for example, a portion with a width gradually decreasing toward the seal continuity portion 64*a*. More specifically, a separation distance between a portion of the side edge sealing portion 61 that defines the lower second non-attached region 81*b* and a portion of the outer peripheral side main-body sealing portion 26*a* that defines the lower second non-attached region 81*b* gradually decreases toward upside (the seal continuity portion 64*a*). Consequently, even if there is an impact on the sheet member container 100 (due to the falling or the like), the impact on the seal continuity portion 64*a* can be reduced. It is therefore possible to favorably maintain the state where the film layers adjacent to each other or the resin layers forming the respective film layers are attached to each other in the seal continuity portion 64*a*.

The second non-attached region 81 has a width gradually decreasing from the position of the bottom-portion-side intersection point 66 toward the seal continuity portion 64*a*. More specifically, the width of the lower second non-attached region 81*b* gradually decreases from the position of the bottom-portion-side intersection point 66 toward the seal continuity portion 64*a*.

Consequently, even when if there is an impact on the sheet member container 100 (due to the falling or the like), the impact on the seal continuity portion 64*a* can be more reduced. It is therefore possible to further favorably maintain the state where the film layers adjacent to each other or the resin layers forming the respective film layers are attached to each other.

Also, the second non-attached region 81 has, for example, a width gradually decreasing from the position of the bottom-portion-side intersection point 66 toward the downside. More specifically, the width of the lower second non-attached region 81*b* gradually decreases from the position of the bottom-portion-side intersection point 66 toward the seal continuity portion 64*c*.

Consequently, even if there is an impact on the sheet member container 100 (due to the falling or the like), the impact on the seal continuity portion 64*c* can be more reduced. It is therefore possible to further favorably maintain the state where the film layers adjacent to each other or the resin layers forming the respective film layers are attached to each other.

Here, in the case of this exemplary embodiment, for example, the body portion 11 is formed into a wide-based shape in the state where the filler is contained in the filling portion 70. More specifically, a width size of the body portion 11 gradually slightly increases toward downside. Also, as illustrated in FIG. 2, a width size of the body portion 11 in the front-rear direction also gradually slightly increases toward the downside.

Then, a width size of at least a portion of the lower second non-attached region 81*b* on the lower side of the seal continuity portion 64*a* gradually increases toward the downside. More specifically, the lower second non-attached region 81*b* includes a portion defined by the side edge sealing portion 61 and the outer peripheral side main-body sealing portion 26*a*, and a portion defined by the bottom-portion peripheral edge sealing portion 63 and the outer peripheral side main-body sealing portion 26*a*. A width size of the portion of the lower second non-attached region 81*b* that is defined by the side edge sealing portion 61 and the outer peripheral side main-body sealing portion 26*a* gradually increases toward the upper end of the bottom-portion peripheral edge sealing portion 63. In other words, a region in which the lower second non-attached region 81*b* is formed is relatively large around an intersection point between the side edge sealing portion 61 and the bottom-portion peripheral edge sealing portion 63.

Consequently, the sheet member container 100 has a structure with more flexibility in a portion where the first sheet portion 31, the second sheet portion 32 and the bottom-portion forming sheet portion 38 are densely arranged, and hence the structural strength of the sheet member container 100 can be improved.

Also, a width size of the portion of the lower second non-attached region 81*b* that is defined by the bottom-portion peripheral edge sealing portion 63 and the outer peripheral side main-body sealing portion 26*a* gradually reduces toward the seal continuity portion 64*c*. Consequently, even if there is an impact on the sheet member container 100 (due to the falling or the like), the impact on the seal continuity portion 64*c* can be reduced. It is therefore possible to favorably maintain the state where the film layers adjacent to each other are attached to each other in the seal continuity portion 64*c*.

As illustrated in FIG. 7, for example, a fourth non-attached region 84 in which the film layers that form the sheet member container 100 are not attached to each other is disposed between the bottom-portion peripheral edge sealing portion 63 and the main-body sealing portion 26, in a region of at least part of the bottom portion 13.

Consequently, a pair of left and right-side edge portions of the bottom portion 13 have a structure with a flexibility, and hence the bottom-portion filling portion 73 can be favorably expanded into a desired shape. Thus, the bottom-portion filling portion 73 can be sufficiently in contact with a mounting surface, and hence a freestanding property of the sheet member container 100 can be improved.

More specifically, the fourth non-attached region 84 is, for example, formed in each of the pair of left and right-side edge portions of the bottom portion 13, and extends from a front-end portion to a rear-end portion of the bottom portion 13. The fourth non-attached region 84 has, for example, a width gradually decreasing toward the front seal continuity portion 64*c* and gradually decreasing toward the rear seal continuity portion 64*c*.

Also, the fourth non-attached region 84 is disposed on an inner side of the skirt portion 75.

The right fourth non-attached region 84 is defined by the bottom-portion peripheral edge sealing portion 63*a* and a portion of the outer peripheral side main-body sealing portion 26*a*. The left fourth non-attached region 84 is defined by the bottom-portion peripheral edge sealing portion 63*b* and a portion of the outer peripheral side main-body sealing portion 26*a*.

A ratio of a region in which the second non-attached region 81 is disposed along the side edge sealing portion 61 in an overall length in the direction in which the side edge sealing portion 61 extends is equal to or more than 50%.

Consequently, when the user grips the sheet member container 100, a portion of the side edge sealing portion 61 that corresponds to the second non-attached region 81 naturally touches the user's fingers and palm, and hence the texture of the sheet member container 100 can be softer.

Note that in the above description, an example where the second non-attached region 81 is formed in each of the pair of side edge portions 12 of the body portion 11 has been described, but the present invention is not limited to this example. The second non-attached region 81 may be formed only in one of the pair of side edge portions 12 of the body portion 11. Also, the second non-attached region 81 may be formed only on one of the first surface portion 20*a* side and the second surface portion 20*b* side of the body portion 11.

Modification 1 of First Exemplary Embodiment

Figure 9:
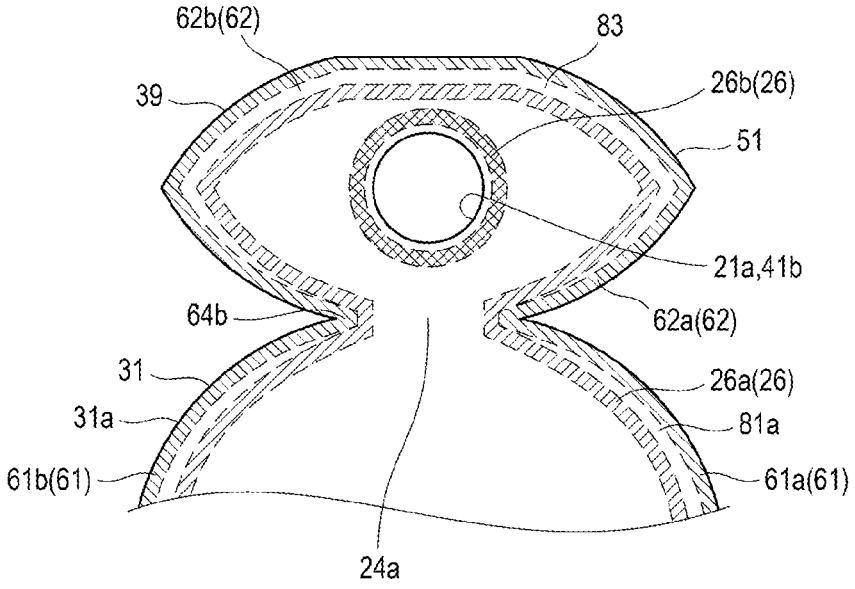
FIG. 9 is a plane view illustrating a container forming sheet member of a sheet member container according to Modification 1 of the first exemplary embodiment.

Next, Modification 1 of the first exemplary embodiment will be described with reference to FIG. 9. In addition, FIG. 9 is a partially enlarged view of a peripheral structure of the top-portion forming sheet portion 39. FIG. 9 illustrates a region in which the peripheral edge sealing portion 60 is formed, with hatching rising to the left, and illustrates a region in which the main-body sealing portion 26 is formed, with hatching rising to the right.

The sheet member container 100 according to this modification is different from the sheet member container 100 according to the above first exemplary embodiment in terms of points described below. In other points, the container is configured similarly to the sheet member container 100 according to the above first exemplary embodiment.

In a case of this modification, as illustrated in FIG. 9, a third non-attached region 83 in which film layers forming the sheet member container 100 are not attached to each other is disposed between the top-portion peripheral edge sealing portion 62 and the main-body sealing portion 26, for example, in a region of at least part of the top portion 14.

The third non-attached region 83 is formed into a circular shape along a peripheral edge portion of the top-portion forming sheet portion 39, for example, in plane view.

According to the above-described configuration, the sheet member container 100 has a structure with a favorable flexibility in the peripheral edge portion of the top portion 14. Consequently, for example, texture when a user grips the top-portion peripheral edge sealing portion 62 to mount and remove the cap portion 90 can be softened.

Modification 2 of First Exemplary Embodiment

Figure 10B:
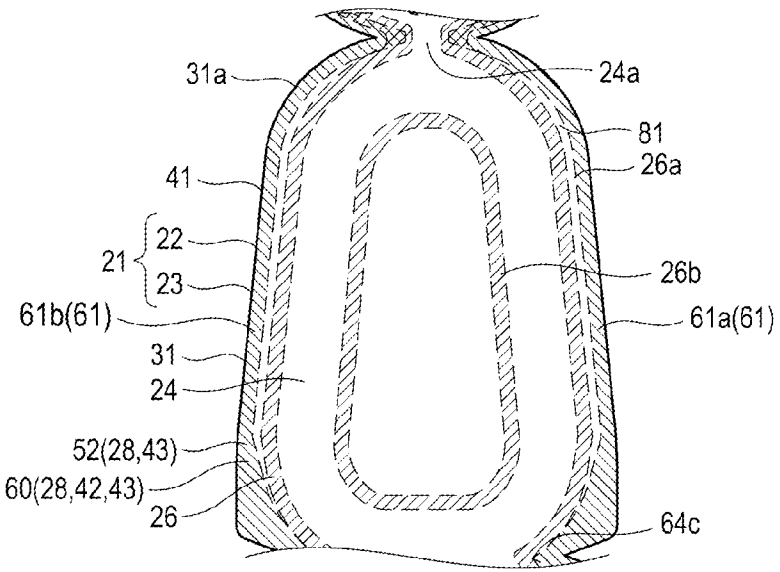
Figure 10A:
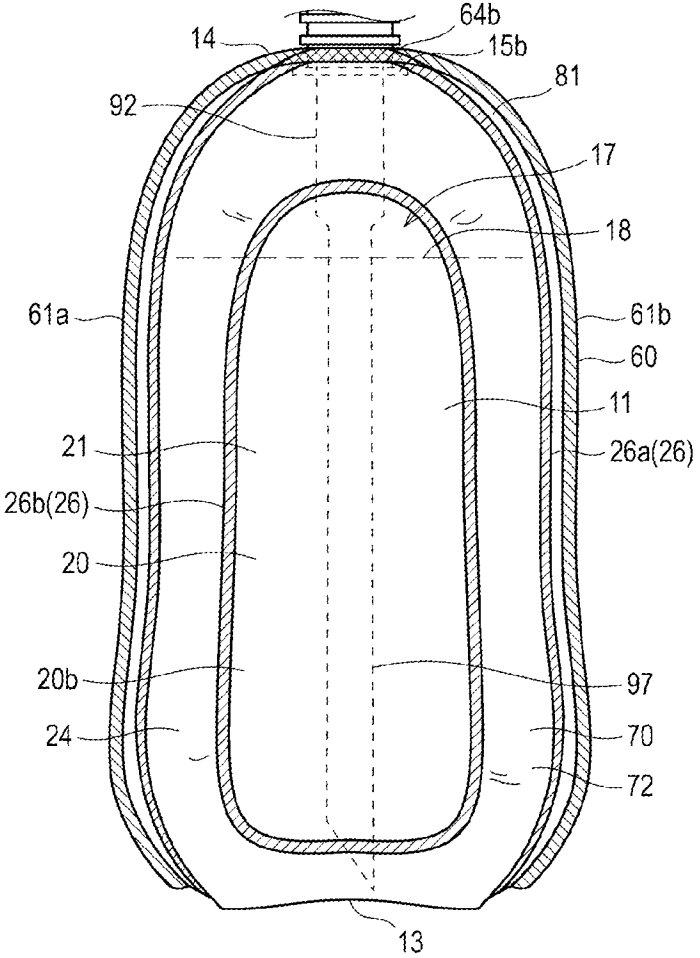

Next, Modification 2 of the first exemplary embodiment will be described with reference to FIG. 10A and FIG. 10B. In addition, FIG. 10A and FIG. 10B illustrate a peripheral structure of the body portion 11 in partially enlarged view. Also, FIG. 10A and FIG. 10B illustrate a region in which the peripheral edge sealing portion 60 is formed, with hatching rising to the left, and illustrate a region in which the main-body sealing portion 26 is formed, with hatching rising to the right.

The sheet member container 100 according to this modification is different from the sheet member container 100 according to the above first exemplary embodiment and Modification 1 in terms of points described below. In other points, the container is configured similarly to the sheet member container 100 according to the above first exemplary embodiment and Modification 1.

As illustrated in FIG. 10A and FIG. 10B, the second non-attached region 81 according to this modification extends continuously over from a position adjacent to one end portion of the side edge sealing portion 61 to a position adjacent to the other end portion thereof.

More specifically, the body portion 11 does not include the seal continuity portion 64*a*, and the second non-attached region 81 extends continuously over from a position adjacent to an upper end portion of the side edge sealing portion 61 to a position adjacent to a lower end portion thereof. An upper end of the second non-attached region 81 extends to the vicinity of a center of an upper end portion of the body portion 11 in a lateral direction, and a lower end of the second non-attached region 81 extends to the vicinity of a lower edge of the skirt portion 75.

Therefore, a pair of side edge portions 12 of the body portion 11 has a favorable flexibility over a substantially entire region in an up-down direction. Consequently, texture at the time of gripping is favorable in any portion of the pair of side edge portions 12 in the up-down direction.

Second Exemplary Embodiment

Next, a second exemplary embodiment will be described with reference to FIG. 11A and FIG. 11B.

A sheet member container 100 according to this exemplary embodiment is different from the sheet member container 100 according to the above first exemplary embodiment in terms of points described below. In other points, the container is configured similarly to the sheet member container 100 according to the above first exemplary embodiment.

Figure 11A:
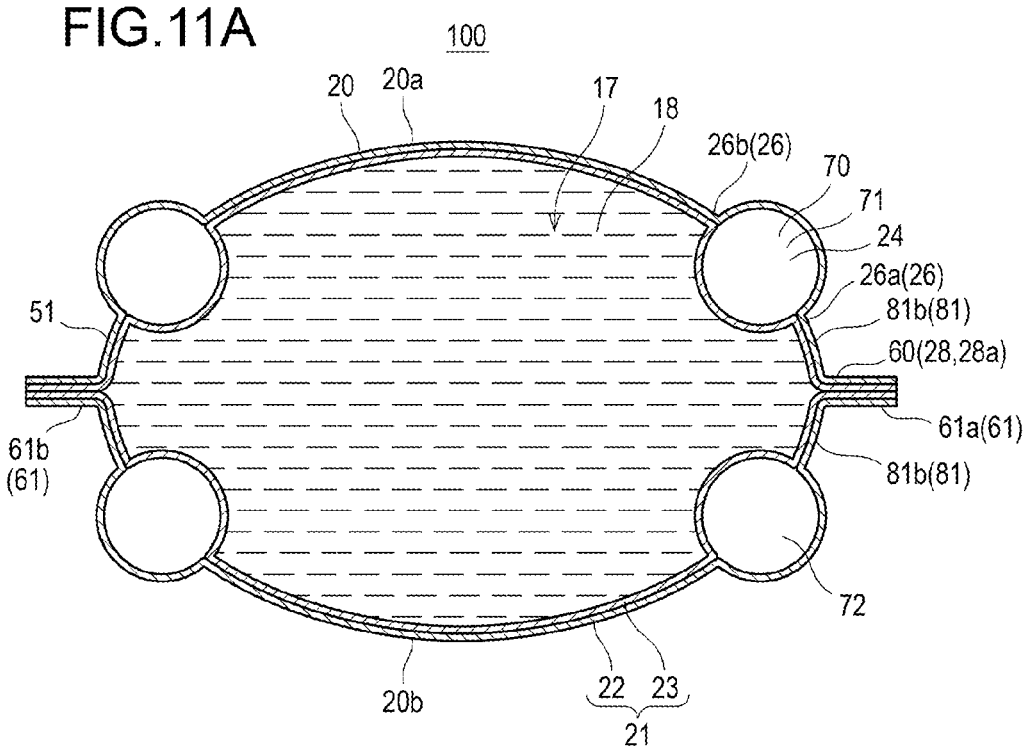
Figure 11B:
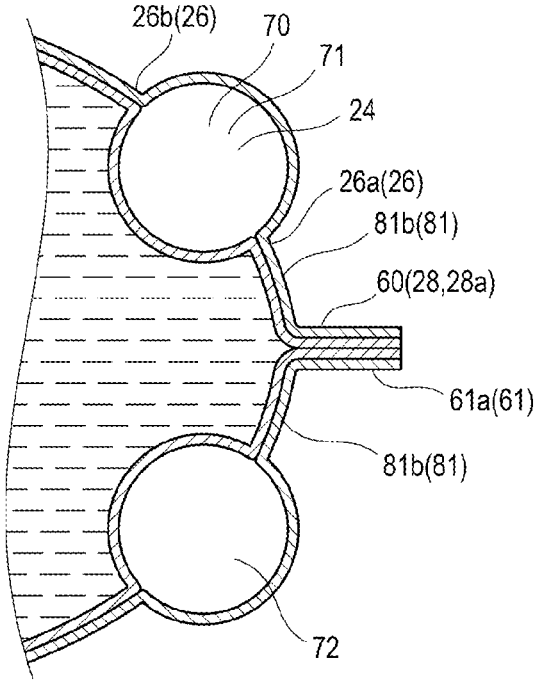

As illustrated in FIG. 11A and FIG. 11B, in a case of this exemplary embodiment, the sheet member container 100 does not include an inner bag 40. Then, a container main body 20 constitutes a containing portion 17. That is, in a peripheral edge sealing portion 60 (see FIG. 1 and the like), portions of an inner film layer 23 of a main-body forming sheet member 21 are attached to each other to form an inner film layer sealing portion 28*a*. Consequently, the container main body 20 is formed and the containing portion 17 is constituted. In other words, an outer film layer 22 and the inner film layer 23 are attached to each other and portions of the inner film layer 23 are attached to each other in the peripheral edge sealing portion 60.

Also, in a second non-attached region 81, the outer film layer 22 and the inner film layer 23 are not attached to each other.

The present invention is not limited to the above-described exemplary embodiments. Various modes such as changes and modifications are also included, provided that the object of the present invention is achieved.

For example, an example where the sheet member container 100 is a pump container including the pump portion 92 has been described above, but the sheet member container 100 may be other than the pump container. For example, the sheet member container 100 may include a cap (a screw cap or the like) that closes the outlet cylinder portion 15*a*.

In this case, the sheet member container 100 includes the bottom portion 13, and a discharge port may have a mode of independently standing with an upward posture, or the discharge port may have a mode of independently standing with a downward posture (inverted posture).

Alternatively, various constituent components of the sheet member container 100 do not have to exist individually and independently. For example, it may be allowed that a plurality of constituent components are formed as a member, one constituent component is formed of a plurality of members, one constituent component is part of the other constituent component, or part of one constituent component overlaps with part of the other constituent component.

REFERENCE SIGNS LIST

11 body portion
12 side edge portion
13 bottom portion
14 top portion
15 spout member
17 containing portion
18 contents
20 container main body
20*a* first surface portion
20*b* second surface portion
21 main-body forming sheet member
22 outer film layer
23 inner film layer
24 non-attached region
25 extending portion
26 main-body sealing portion
28 main-body peripheral edge sealing portion
31 first sheet portion
32 second sheet portion
38 bottom-portion forming sheet portion
39 top-portion forming sheet portion
40 inner bag
40*a* first main surface portion
40*b* second main surface portion
41 inner-bag forming sheet member
42 inner-bag sealing portion
43 inner-outer sealing portion
51 container forming sheet member
52, 60 peripheral edge sealing portion
61 side edge sealing portion
62 top-portion peripheral edge sealing portion
63 bottom-portion peripheral edge sealing portion
64*a*, 64*b*, 64*c* seal continuity portion
65 top-portion-side intersection point
66 bottom-portion-side intersection point
70 filling portion
71 first body-portion filling portion
72 second body-portion filling portion
73 bottom-portion filling portion
74 top-portion filling portion
75 skirt portion
81 second non-attached region
81*a* upper second non-attached region
81*b* lower second non-attached region
83 third non-attached region
84 fourth non-attached region
90 cap portion
91 attachment portion
92 pump portion
93 head portion
94 support cylinder portion
95 nozzle portion
96 discharge port
97 dip tube
100 sheet member container

The invention claimed is:

1. A sheet member container comprising:

one or more sheet members including a main-body forming sheet member in which a plurality of film layers including an inner film layer and an outer film layer are stacked;

a containing portion that accommodates contents;

a container main body including the main-body forming sheet member, and surrounding the containing portion, wherein the main-body forming sheet member includes a main-body sealing portion that is an attached region of the inner film layer and the outer film layer, a non-attached region in which the inner film layer and the outer film layer are partially not attached, and a filling portion in which a filler is contained between layers of the inner film layer and the outer film layer in the non-attached region; and a peripheral edge sealing portion in which the one or more sheet members are folded along a folding line, and peripheral edge portions of the one or more sheet members are attached to each other, wherein the container main body is formed into a shape including a body portion, wherein the peripheral edge sealing portion includes a side edge sealing portion extending along each of a pair of side edges of the body portion, and in a region of at least part of the side edge sealing portion in an extending direction, a second non-attached region in which film layers forming the sheet member container are not attached to each other is disposed between the side edge sealing portion and the main-body sealing portion.

2. The sheet member container according to claim 1, wherein a plurality of second non-attached regions arranged away from each other in a direction in which the side edge sealing portion extends are formed in the body portion.

3. The sheet member container according to claim 2, wherein:

the container main body includes a top portion located on an upper side of the body portion, and a bottom portion located on a lower side of the body portion, a seal continuity portion in which the side edge sealing portion is connected to the main-body sealing portion is disposed above a central position of the body portion in a height direction, and the plurality of second non-attached regions are arranged on an upper side and a lower side of the seal continuity portion, respectively.

4. The sheet member container according to claim 3, wherein the second non-attached region on the upper side of the seal continuity portion includes a portion with a width gradually decreasing toward the seal continuity portion.

5. The sheet member container according to claim 3, wherein the second non-attached region on the lower side of the seal continuity portion includes a portion with a width gradually decreasing toward the seal continuity portion.

6. The sheet member container according to claim 5, wherein the body portion is formed into a wide-based shape in a state where the filler is contained in the filling portion.

7. The sheet member container according to claim 1, wherein the second non-attached region extends continuously over from a position adjacent to one end portion of the side edge sealing portion to a position adjacent to the other end portion.

8. The sheet member container according to claim 1, wherein in each of a pair of side edge portions of the body portion, the second non-attached region is disposed between the side edge sealing portion and the main-body sealing portion.

9. The sheet member container according to claim 1, wherein:

the body portion includes a first surface portion, and a second surface portion opposed to the first surface portion with the containing portion being disposed therebetween, and in each of the first surface portion and the second surface portion, the second non-attached region is disposed between the side edge sealing portion and the main-body sealing portion.

10. The sheet member container according to claim 1, further comprising:

an inner bag disposed inside of the container main body, wherein the inner bag is formed by attaching portions of a peripheral edge portion of an inner-bag forming sheet member to each other, and in the second non-attached region, a film layer forming the main-body forming sheet member and the inner-bag forming sheet member are not attached.

11. The sheet member container according to claim 1, wherein:

the container main body includes a top portion located on an upper side of the body portion, and a bottom portion located on a lower side of the body portion, the peripheral edge sealing portion includes a top-portion peripheral edge sealing portion disposed along a peripheral edge of the top portion, and the second non-attached region extends continuously over from a position above a top-portion-side intersection point that is an intersection point between an upper end of the side edge sealing portion and the top-portion peripheral edge sealing portion to a position below the intersection point.

12. The sheet member container according to claim 11, wherein the second non-attached region has a width that is largest at a position of the top-portion-side intersection point in a height direction.

13. The sheet member container according to claim 11, further comprising:

a seal continuity portion in which the side edge sealing portion is connected to the main-body sealing portion, below the second non-attached region, wherein the second non-attached region has a width gradually decreasing from a position of the top-portion-side intersection point toward the seal continuity portion.

14. The sheet member container according to claim 11, wherein the second non-attached region has a width gradually decreasing from a position of the top-portion-side intersection point toward upside.

15. The sheet member container according to claim 1, wherein:

the container main body includes a top portion located on an upper side of the body portion, and a bottom portion located on a lower side of the body portion, the peripheral edge sealing portion includes a bottom-portion peripheral edge sealing portion disposed along a peripheral edge of the bottom portion, and the second non-attached region extends continuously over from a position above a bottom-portion-side intersection point that is an intersection point between a lower end of the side edge sealing portion and the bottom-portion peripheral edge sealing portion to a position below the intersection point.

16. The sheet member container according to claim 15, wherein the second non-attached region has a width that is largest at a position of the bottom-portion-side intersection point in a height direction.

17. The sheet member container according to claim 15, further comprising:

a seal continuity portion in which the side edge sealing portion is connected to the main-body sealing portion, above the second non-attached region, wherein the second non-attached region has a width gradually decreasing from a position of the bottom-portion-side intersection point toward the seal continuity portion.

18. The sheet member container according to claim 15, wherein the second non-attached region has a width gradually decreasing from a position of the bottom-portion-side intersection point toward downside.

19. The sheet member container according to claim 1, wherein in the peripheral edge sealing portion, film layers adjacent to each other in film layers forming the sheet member container are all attached to each other.

20. The sheet member container according to claim 1, wherein a filler is contained in the filling portion.

* * * * *